US006538618B2

(12) United States Patent
Yamamoto et al.

(10) Patent No.: US 6,538,618 B2
(45) Date of Patent: Mar. 25, 2003

(54) ANTENNA

(75) Inventors: Atsushi Yamamoto, Osaka (JP); Hiroshi Iwai, Neyagawa (JP); Koichi Ogawa, Hirakata (JP)

(73) Assignee: Matsushita Electric Industrial Co., Ltd., Osaka (JP)

( * ) Notice: Subject to any disclaimer, the term of this patent is extended or adjusted under 35 U.S.C. 154(b) by 0 days.

(21) Appl. No.: 09/975,517

(22) Filed: Oct. 12, 2001

(65) Prior Publication Data

US 2002/0047805 A1 Apr. 25, 2002

(30) Foreign Application Priority Data

Oct. 13, 2000 (JP) ..... 2000-313730

(51) Int. Cl.[7] ..... H01Q 1/42

(52) U.S. Cl. ..... 343/789; 343/700 MS; 343/752; 343/768

(58) Field of Search ..... 343/700 MS, 767, 343/770, 769, 768, 752, 829, 830, 846, 789; H01Q 1/42

(56) References Cited

U.S. PATENT DOCUMENTS

| | | | | |
|---|---|---|---|---|
| 3,312,976 A | | 4/1967 | Gregory | |
| 4,086,598 A | * | 4/1978 | Bogner | 343/768 |
| 4,371,877 A | | 2/1983 | Doussot et al. | |
| 4,675,685 A | * | 6/1987 | Finken | 343/708 |
| 4,803,494 A | | 2/1989 | Norris et al. | |
| 5,233,364 A | * | 8/1993 | Lefeuvre et al. | 343/789 |
| 5,465,100 A | * | 11/1995 | Remondiere et al. | 343/769 |
| 5,539,418 A | * | 7/1996 | Egashira et al. | 343/712 |
| 5,905,471 A | * | 5/1999 | Biebl et al. | 343/769 |

FOREIGN PATENT DOCUMENTS

| | | |
|---|---|---|
| EP | 0 439 677 | 8/1991 |
| EP | 0 649 185 | 4/1995 |
| JP | 2000-134026 | 5/2000 |

* cited by examiner

*Primary Examiner*—Tho Phan
(74) *Attorney, Agent, or Firm*—Wenderoth, Lind & Ponack, L.L.P.

(57) ABSTRACT

An antenna is provided having a relatively simple structure as arranged capable of operating at desired frequencies. The antenna has a chassis having a grounding conductor provided as a bottom surface, a ceiling conductor provided as a top surface opposite to the grounding conductor, and side conductors provided as antenna sides. At least one opening is provided in a part of said chassis, which opens for radiation of electric waves. A feeding point provided on the grounding conductor for connection to a power supply via a predetermined feeding line from the outside. An antenna element connected to the feeding point at one end while being connected to the ceiling conductor via a frequency selectable circuit at the other end, and surrounded by the side conductors.

36 Claims, 25 Drawing Sheets

ANTENNA

FIELD OF THE INVENTION

The present invention relates to an antenna.

BACKGROUND OF THE INVENTION

A conventional antenna will be described referring to FIGS. 33 to 36. As well shown in FIG. 33, the antenna 130 comprises a chassis is configured with a grounding conductor 131 provided as the bottom surface thereof, two top conductors 135 and 118 provided as the top surface thereof opposite to the grounding conductor 131, and side conductors 134 provided as the antenna sides. The grounding conductor 131, the side conductors 134, and the ceiling conductors 135 and 138 are electrically connected to each other. A feeding point 132 is provided on the grounding conductor 131 for receiving electric power from the outside. The feeding point 132 is electrically connected to one end of an antenna element 133 made of a conductive wire while the other end is connected electrically and mechanically by soldering or the like to a linear conductor 139 which is provided at the center on the top surface of the antenna. Furthermore, there is a pair of openings 136 and 137 provided symmetrically on both sides of the linear conductor 139 on the top surface of the antenna for radiation of electric waves.

FIG. 34 illustrates an example of setting dimensions of the antenna 130. It is assumed in FIGS. 33 and 34 that the X, Y, and Z set a three-dimensional coordinate space. The antenna 130 is arranged with the grounding conductor 131 sitting on the XY-plane, the feeding point 132 defining the origin, and the linear conductor 139 extending along the Y-axis, hence having a symmetrical structure to each of the ZY-plane and the ZX-plane. In this example, the grounding conductor 131 is formed of a square shape having each side of $0.76\times\lambda$ along the X and Y-axes ($\lambda$ being the free space wavelength) based on the free space wavelength. The height along the Z-axis of the side conductors 134 is set as $0.08\times\lambda$. The length along the X-axis of the openings 136 and 137 provided on both sides of the linear conductor 139 at the center of the top surface of the antenna is $0.19\times\lambda$ while the side along the X-axis of the ceiling conductors 135 and 138 is set as $0.19\times\lambda$. The length along the Z-axis of the antenna element 133 is set as $0.08\times\lambda$.

FIG. 35 illustrates a VSWR characteristic curve of the input impedance characteristic to a 50 Ω feeding line in the antenna 110 set as described. The horizontal axis in the figure is normalized by the resonance frequency f0. It is then apparent from the figure that the frequency band lower than 2 of VSWR extends 10% or higher, and the reflection loss is smaller throughout the wide band resulting in improvement of the impedance.

FIG. 36 illustrates the radiation directivity on the antenna 130. The circular chart expressed the radiation directivity is 10 dB per scale and the unit is dBi based on the radiation power at the point waveform source. As apparent from the diagram, the antenna 130 has a bidirectivity of electric wave radiation along the X direction while along the Y direction is minimized. The antenna 130 having such characteristics is useful in a long, narrow interior space such as a corridor.

The antenna 130 has the openings 136 and 137 provided in the top surface thereof for radiation of electric waves. As the antenna element 133 acting as the electric wave radiation source is surrounded by the grounding conductor 131 and the side conductor 134, the electric wave radiation effect will be negligible to the four sides and the bottom (i.e. a positional environment). According to the above characteristic, the antenna 130 can simply be mounted to any indoor location such as a ceiling with the body embedded but the top surface exposed to the radiation space so that it is flush with the ceiling surface. As a result, the antenna exhibits the projecting object from the setting surface thus being less noticeable in the view and more preferable in the appearance.

Also, in the antenna 130, the height of the antenna element 133 is set as $0.08\times\lambda$ and it is lower than that of a known ¼ wavelength antenna element. This contributes to the downsizing of the antenna. Accordingly, even if the antenna is hardly embedded in the setting surface such as a ceiling, the projecting object can be minimized thus being less noticeable in the view and more preferable in the appearance.

Moreover, the antenna 130 is symmetrical structure on both the ZY-plane and the ZX-plane. This permits the directivity of electric wave radiation to be symmetrical toward each of the ZY-plane and the ZX-plane.

However, the conventional antenna 130 having the foregoing structure can be resonant only at an odd number multiple of the fundamental frequency but hardly operated at any desired group of frequencies. It is hence necessary for radiation of electric waves at different frequencies to provide a corresponding number of the antennas. The more the number of the antennas, the greater the space for installation of the antennas will be increased. Also, an increase in the number of the antennas requires a more number of transmission lines thus further increasing the installation space. Accordingly, when the installation space is too large, the antenna can hardly be mounted with less visibility thus failing to improve the appearance.

The present invention has been developed in view of the above technical drawbacks and the object is to provide an antenna which can radiate electric waves at a plurality of desired frequencies while it is made relatively simple in the structure and minimized the antenna body.

SUMMARY OF THE INVENTION

In an aspect of the present invention, there is provided an antenna comprising: a chassis consisting mainly of a grounding conductor provided as a bottom surface, a ceiling conductor provided as a top surface opposite to the grounding conductor, and side conductors provided as antenna sides; at least one opening provided in apart of said chassis, which opens for radiation of electric waves; a feeding point provided on said grounding conductor for power supply via a predetermined feeding line from the outside; and an antenna element connected to said feeding point at one end while being connected to said ceiling conductor via a frequency selectable circuit at the other end, and surrounded by the side conductors.

Said ceiling conductor may have a generally annular slit provided therein about the joint between said antenna element and the ceiling conductor, and the inner edge and the outer edge forming the slit of the ceiling conductor may be connected to each other via a frequency selectable circuit different from the frequency selectable circuit at said joint between said antenna element and the ceiling conductor.

Two or more of said generally annular slits may be provided concentrically, and the outer edge and the inner edge forming each of the slits of the ceiling conductor may be connected to each other via respective frequency selectable circuits.

Said chassis may be situated in an XYZ orthogonal coordinate system with said grounding conductor extending along the XY-plane and said feeding point sitting at the origin so that said grounding conductor, the ceiling conductor, and the side conductors are symmetrical about the ZY-plane and the opening in said chassis is symmetrical about the ZY-plane.

Said chassis may be situated in an XYZ orthogonal coordinate system so that said grounding conductor, the ceiling conductor, and the side conductors are symmetrical about the ZX-plane and the opening in said chassis is symmetrical about the ZX-plane.

Said frequency selectable circuit may be configured with a parallel resonance circuit.

Said frequency selectable circuit may be configured with a low-pass filter.

Said frequency selectable circuit may be configured with a changeover switch.

Further, said antenna may comprise a matching conductor provided to match the impedance with said feeding line and electrically connected to the grounding conductor. Said matching conductor may be coupled via the frequency selectable circuit to the grounding conductor. Said matching conductor may be electrically connected to the antenna element.

The inner space of said chassis may be filled partially or entirely with a dielectric.

Said ceiling conductor may be a pattern of a metallic material provided on the dielectric substrate.

Further, said antenna may comprise an electric field adjusting conductor for changing a distribution of the electric field across said opening.

Said electric field adjusting conductor may be coupled via the frequency selectable circuit to said chassis.

Further, said antenna may comprise an opening space variable means for changing the opening space of the opening provided on said chassis.

The grounding conductor provided as the bottom surface of the antenna may be arranged of a circular shape.

Further, said antenna may comprise a transmission/reception circuit for transmitting and receiving signals of a specific frequency or frequency band, said transmission/reception circuit being connected at one end to said antenna element while being connected at the other end to a signal transmission cable which communicates with a predetermined device for processing a baseband signal.

Said transmission/reception circuit may be accommodated in the chassis and shielded with a cover member.

Said grounding conductor may have a hollow protrusive portion provided thereon and the transmission/reception circuit may be located on the lower side of the grounding conductor so as to be accommodated in the hollow space of the protrusive portion.

Said hollow space of the protrusive portion of said grounding conductor may be shielded with a cover member that is provided on the lower side of the grounding conductor.

Said transmission/reception circuit may be composed of passive elements without a power supply.

Said transmission/reception circuit may include a high frequency IC capable of controlling the frequency or frequency band of a signal to be received or transmitted.

Said transmission/reception circuit may include a filter having a predetermined passing frequency band.

Said transmission/reception circuit may include a filter switching circuit having a plurality of filters which are different from each other in the passing frequency band and a filter switch for switching between the filters so that one of the filters becomes available.

Said transmission/reception circuit may include an amplifier for transmission and/or an amplifier for reception.

Said transmission/reception circuit may include a plurality of amplifiers which are different from each other in the gain for transmission and/or reception.

A plurality of said amplifiers for transmission may be connected to said signal transmission cable via a signal divider, said signal divider dividing a signal input from said signal transmission cable to a plurality of signals and outputting the signals to said amplifiers for transmission.

A plurality of said amplifiers for reception may be connected to said signal transmission cable via a signal compositor, said signal compositor compounding a plurality of signals input from said amplifiers for reception to one signal and outputting the signals to said signal transmission cable.

Said signal transmission cable may be an optical fiber, and said transmission/reception circuit may include a light passive element for transmission capable of photoelectric conversion and/or a light active element for reception capable of electric-optic conversion, each of which is connected to said optical fiber.

Said optical fibers to which said light passive element or said light active element is connected, may be coupled to one optical fiber via a photocoupler.

DETAILED DESCRIPTION OF THE INVENTION

Some embodiment of the present invention will be described referring to the accompanying drawings.

First Embodiment

Figure 1:
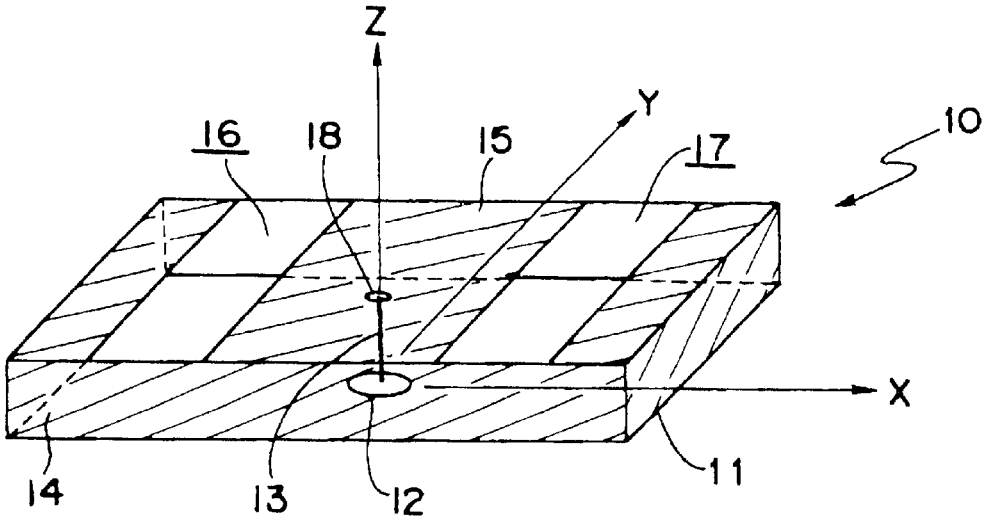
FIG. 1 illustrates a configuration of an antenna according to the first embodiment of the present invention.

FIG. 1 is a perspective view of a configuration of an antenna according to the first embodiment of the present invention. The antenna 10 comprises a grounding conductor 11 provided as the bottom surface thereof, a ceiling conductor 15 provided as the top surface thereof opposite to the grounding conductor 11, and a chassis incorporating side conductors provided as antenna sides. The grounding conductor 11, the side conductors 14, and the ceiling conductor 15 are electrically connected to each other. A feeding point 12 is provided on the grounding conductor 11 for receiving electric power via a feeding line from the outside. The feeding point 12 is electrically connected to one end of an antenna element 13 made of a conductive wire of which the other end extends to the ceiling conductor 15. The other end of the antenna element 13 constitutes a feeder 18 located at the center of the ceiling conductor 15 as will be described later in more detail referring to FIG. 2. There is a pair of openings 16 and 17 provided symmetrically on both sides of the feeder 18 on the ceiling conductor for radiation of electric waves.

Figure 2:
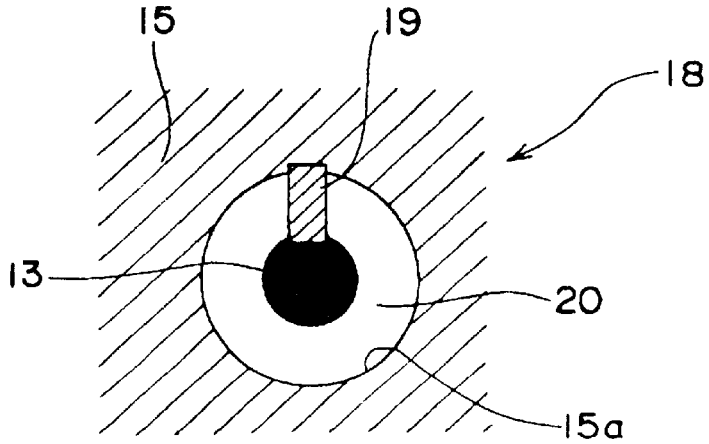
FIG. 2 illustrates an enlargement of a feeder in the antenna.

FIG. 2 is an enlarged view of the feeder 18. The ceiling conductor 15 of the first embodiment has an aperture 15*a* provided therein to accommodate the antenna element 13 at the center. The shape and size of the aperture 15*a* is determined so that the outer edge thereof is spaced by a distance from the radial surface of the antenna element 13. As shown in FIG. 2, the gap between the inner edge at the aperture 15*a* of the ceiling conductor 15 and the antenna element 13 is denoted by 20. Also, the antenna element 13 in the aperture 15*a* is jointed via a frequency selectable circuit 19 to the inner edge of the ceiling conductor 15. In the first embodiment, the frequency selectable circuit 19 is configured with a LC parallel circuit acting as a parallel resonant circuit.

FIG. 1 and the other perspective views of the antenna 10 illustrate a three-dimensional coordinate space defined by X, Y, and Z-axes. The grounding conductor 11 of the antenna 10 lies on the XY-plane while the feeding point 12 represents the origin of the coordinate. The two openings 16 and 17 extend along the Y-axis as are arranged in symmetrical about both the ZY-plane and the ZX-plane.

The action of the antenna 10 having the foregoing configuration will now be explained. For comparison with the antenna 10 to be explained, another antenna (hereinafter referred to as antenna A) having the frequency selectable circuit 19 replaced by a conductor is proposed and the resonant frequency is expressed by f1. In addition, a further antenna (hereinafter referred to as an antenna B) excluding the frequency selectable circuit 19 is proposed and the resonant frequency is f2. In other words, the antenna element 13 and the ceiling conductor 15 of the antenna A are short-circuited to each other. The antenna B produces a series connected electrical capacity due to the presence of the gap 20 between the antenna element 13 and the ceiling conductor 15. As a result the two antennas A and B are different in the resonant frequency.

Figure 8:
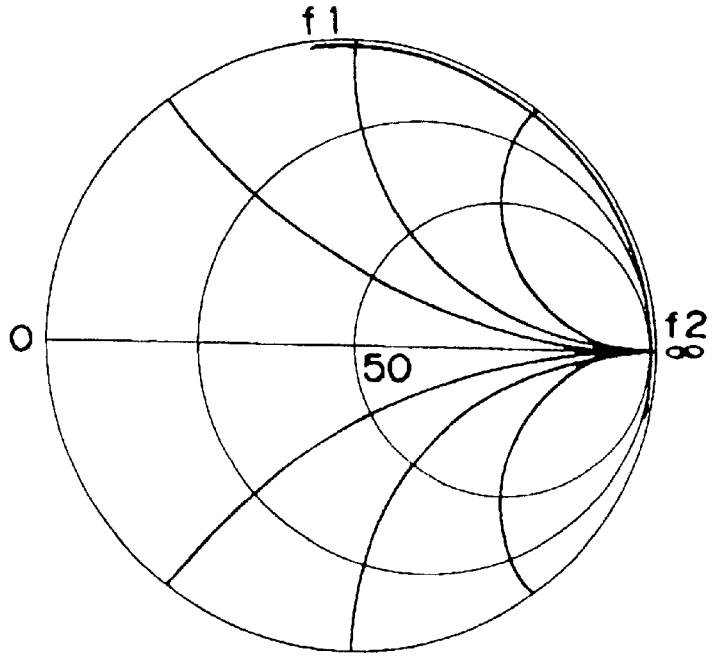
FIG. 8 is a Smith chart of the frequency selectable circuit in the antenna.

The frequency selectable circuit 19 used in the antenna 10 of which the resonant frequency is f2 has a characteristic with a lower impedance at f1 and a higher impedance at f2, as shown in a Smith chart of FIG. 8. If f2 is 2.14 GHz, the inductance L and the capacitance C of the LC parallel circuit as the frequency selectable circuit 19 may be 11 nH and 0.5 pF respectively in a preferable combination. As the frequency selectable circuit 19 is used for joining the antenna element 13 and the ceiling conductor 15 are joined to each other, it produces a lower level of impedance at the frequency of f1 and becomes nearly short-circuited and the action will substantially be equal to that of the antenna A. The frequency selectable circuit 19 produces a high level of impedance at f2 and becomes nearly opened and the action will substantially be equal to that of the antenna B. Accordingly, the antenna 10 having the foregoing configuration can be operated with two difference frequencies of the antennas A and B.

Figure 3A:
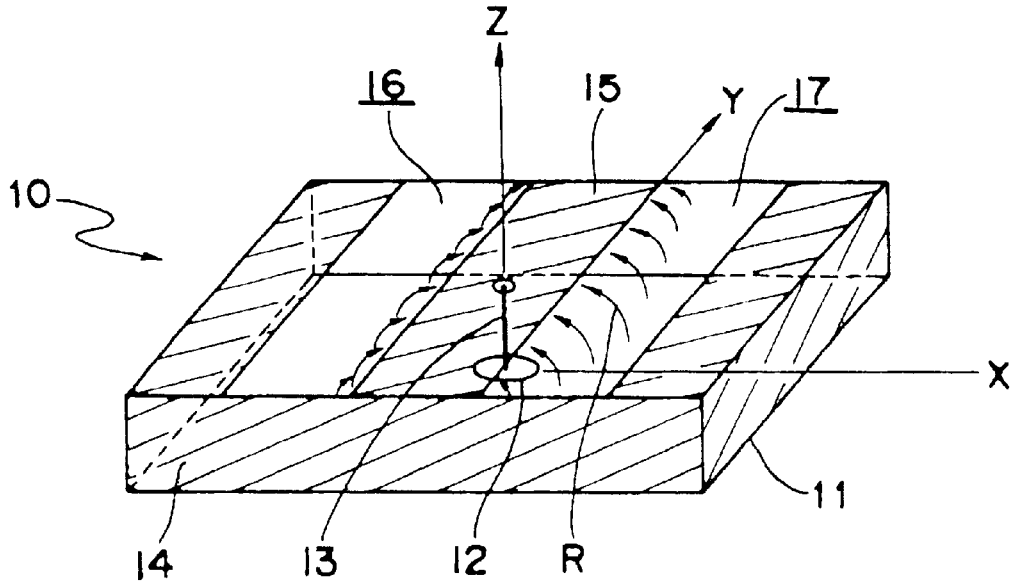
FIG. 3 is an explanatory drawing showing the theory of radiation of electric waves from the antenna.
Figure 3B:
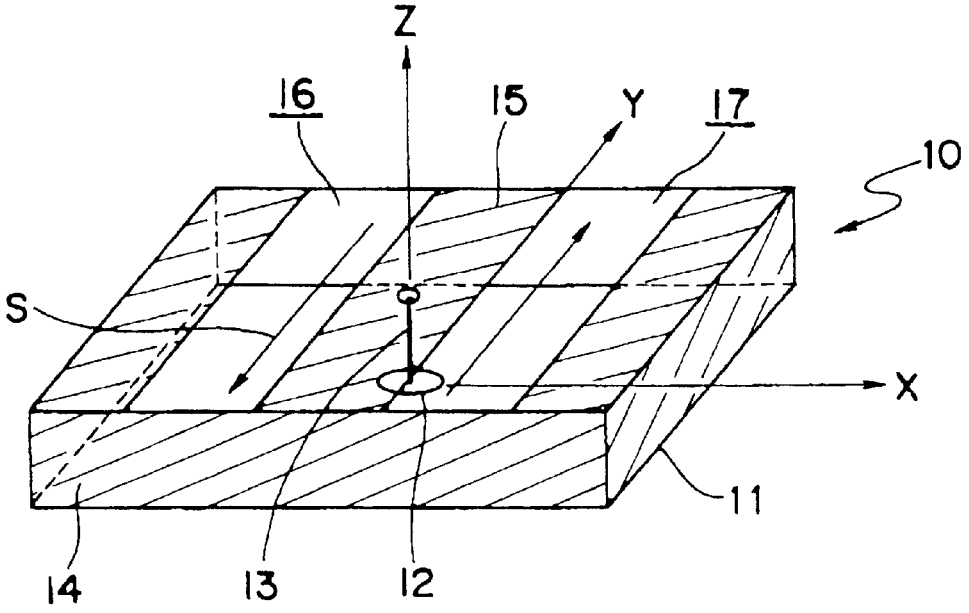

The theory of electric wave radiation from the antenna 10 will be described referring to FIG. 3. The antenna element 13 performs oscillation for radiation of an electric wave at both f1 and f2. The radiated wave is emitted from the two openings 16 and 17 of he ceiling conductor 15 to the outside space. As the two openings 16 and 17 are symmetrical about the antenna element 13 in the antenna 10, the electric field developed by the antenna element 13 is in phase with the openings 16 and 17. Accordingly, the electric field R along the X-axis appears in opposite directions through the openings 16 and 17, as shown in FIG. 3A. Assuming that the electric field R along the X-axis produces electromagnetic lines S, two electromagnetic lines S across their respective openings 16 and 17 run in opposite direction along the Y-axis as two different linear electromagnetic sources which are identical in the amplitude. This allows the radiation of electric wave from the antenna 10 to be derived from the two electromagnetic sources. In other words, the electric wave radiated from the antenna 10 is emitted from an array of the two electromagnetic sources.

More particularly, two components of the electric wave emitted from the two electromagnetic sources are identical in the amplitude but opposite in the phase on the ZY-plane because the two electromagnetic sources are arranged in symmetrical to each other about the ZY-plane. This means the no electric wave components are emitted along the ZY-plane. Also, as the two components are in phase with each other on the ZX-plane, the electric wave emitted from the two electromagnetic sources is emphasized in the intensity. For example, when the distance between the two electromagnetic sources is ½ the wavelength in a free space, the two components are in phase with each other along the X-axis and their intensity can be increased in both the +X direction and the −X direction.

In case that the length along the Y-axis of the openings 16 and 17 is increased, i.e. the two electromagnetic sources are elongated, the electric wave along the X direction is diminished thus increasing the gain. More specifically, the gain can be controlled by adjusting the length of the openings 16 and 17.

Generally, every antenna of which the grounding conductor is arranged of a definite size permits the electric wave to be diffracted at each corner of the grounding conductor. The intensity of electric wave emitted from the antenna having a definite size of the grounding conductor is hence a sum of the output of the antenna element and a diffraction at the corners of the grounding conductor. This is applicable to the antenna 10 where the diffraction appears at every corner or bent of the ceiling conductor 15, the side conductors 14, and the grounding conductor 11. As the ceiling conductor 15 of this embodiment has the two openings 16 and 17, the corner at the openings produces a greater level of diffraction. Accordingly, the directivity of electric wave of the antenna 10 can thus be changed by controlling the location, number, and size of the openings 16 and 17 as well as the size and shape of the ceiling conductor 15, the side conductors 14, and the grounding conductor 11.

Figure 4:
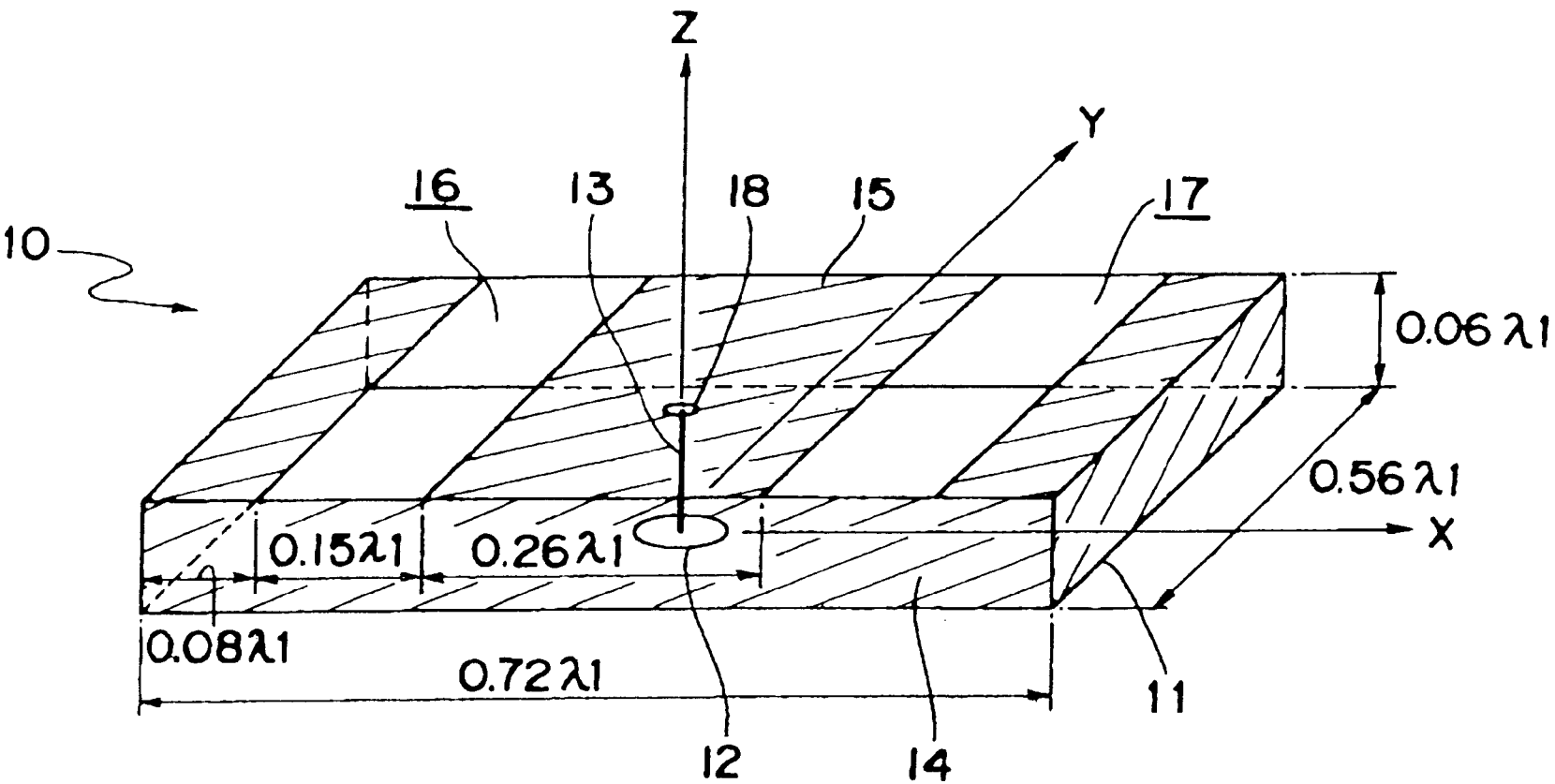
FIG. 4 is an example setting dimensions of the antenna.

FIG. 4 illustrates an example of the dimensions of the antenna 10 where the frequency f2 is 2.6×f1. It is also assumed that the wavelength in a free space is λ1 at f1 and λ2 at f2. The grounding conductor 11 is arranged of a rectangular shape on the XY-plane having a size of 0.72×λ1 by 0.56×λ1. Also, the height of the side conductor is set as 0.06×λ1. The ceiling conductor 15 provided on the XY-plane opposite to the grounding conductor 11 and between the two openings 16 and 17 has a rectangular portion thereof elongated along the Y-axis with the one side parallel to the X-axis set as 0.26×λ1 and the other side parallel to the Y-axis set as 0.56×λ1. Also, the ceiling conductor 15 has a rectangular portion thereof provided at each end of the top surface thereof as elongated along the Y-axis with the one side parallel to the X-axis set as 0.08×λ1 and the other side parallel to the Y-axis set as 0.56×λ1.

Each of the two openings 16 and 17 provided in the ceiling conductor 15 has a rectangular shape elongated along the Y-axis with the one side parallel to the X-axis set as 0.15×λ1 and the other side parallel to the Y-axis set as 0.56×λ1. Also, the antenna element 13 extends along the Z-axis and is set as 0.015×λ1 in the diameter and 0.06×λ1 in the length. The antenna 10 has a symmetrical structure about both the ZX-plane and the ZY-plane which are orthogonal to each other.

Figure 5A:
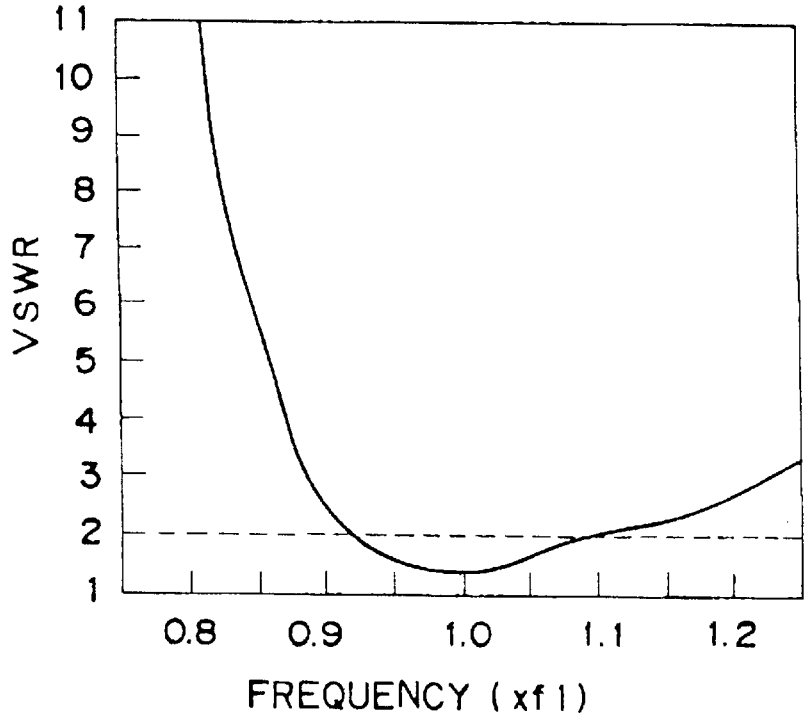
FIG. 5A is a graph showing an impedance profile of an antenna A where the frequency selectable circuit is replaced by a conductor and FIG. 5A is a graph showing an impedance profile of an antenna B where the frequency selectable circuit is eliminated.
Figure 5B:
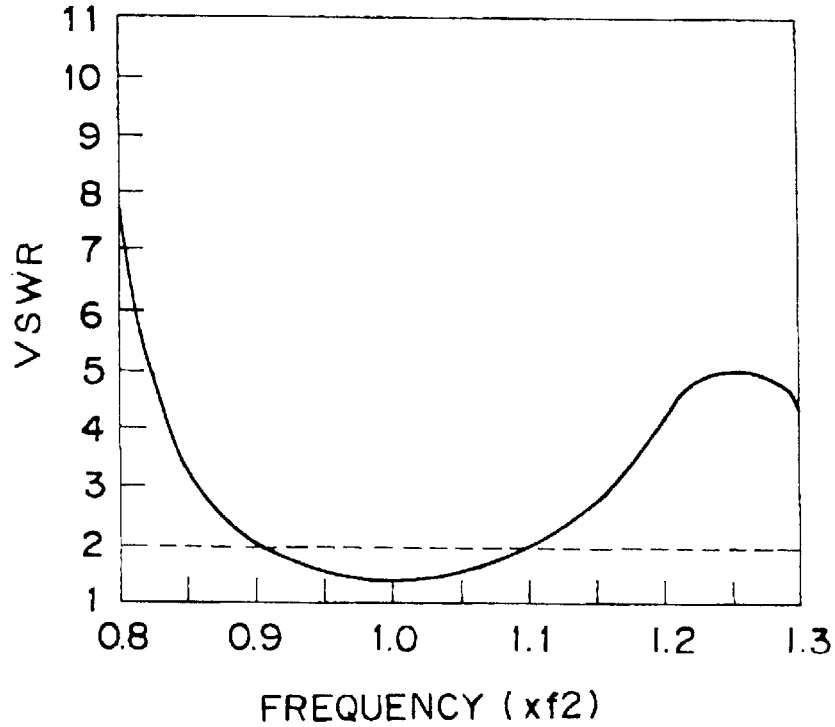
Figure 6:
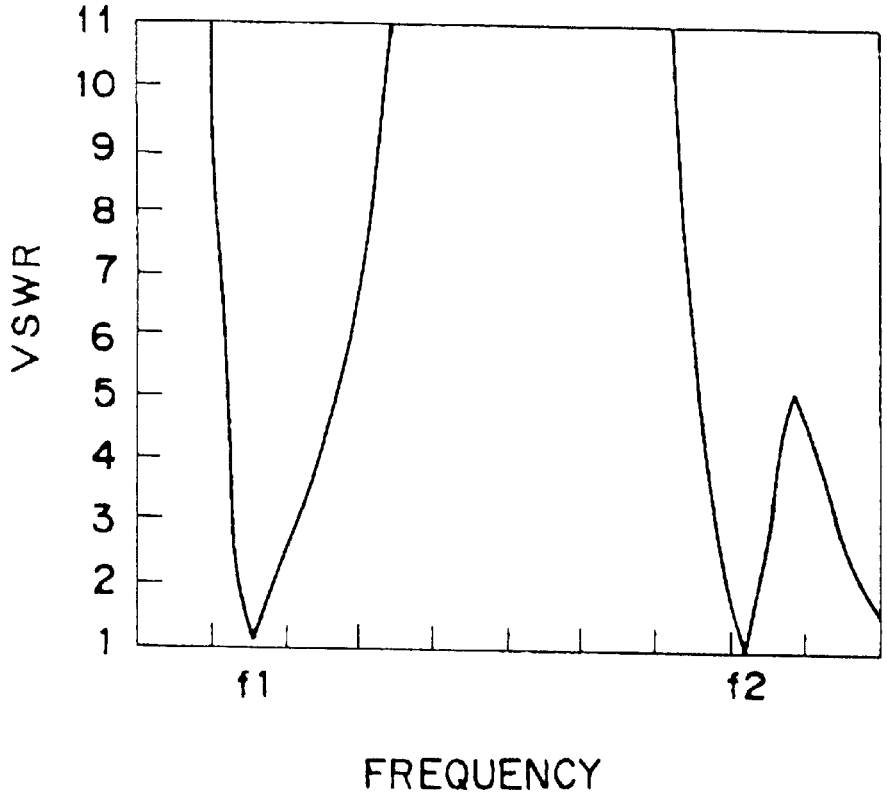
FIG. 6 is a graph showing an impedance profile of the antenna where the frequency selectable circuit is a PC parallel circuit.

The impedance and radiation directivity of the antenna 10 sized as described above will now be explained. FIGS. 5A and 5B and FIG. 6 illustrate VSWR characteristics of the input impedance at the 50 Ω feeding line of the antenna 10.

FIG. 5A illustrates an impedance characteristic of the antenna A where the frequency selectable circuit 19 is replaced by a conductor, indicating that a resonant action occurs at the center frequency f1. FIG. 5B illustrates an impedance characteristic of the antenna B where the frequency selectable circuit 19 is removed, indicating that a resonant action occurs at the center frequency f2. When the VSWR is lower than 2, a frequency band of either the antenna A or B extends 10% or higher thus ensuring an improved level of the impedance throughout the wide band and minimizing the reflection loss.

FIG. 6 illustrates an input impedance characteristic of the antenna 10 where a LC parallel circuit is implemented as the frequency selectable circuit 19. As apparent, the resonant action appears at both the frequencies f1 and f2. It is hence proved that the antenna 10 has a higher level of the impedance characteristic at each of the two different frequencies while increasing no reflection loss.

The height of the antenna element 13 in the antenna 10 is set as 0.06×λ1 (0.16×λ2) which is smaller than that of a known ¼ wavelength antenna element. This is equivalent to the fact that capacitive coupling is developed between the ceiling conductor 15 and the grounding conductor 11 in the antenna 10 and a capacitive load is provided at the distal end of the antenna element 13. Accordingly, the antenna 10 of the first embodiment can perform a resonant action at different frequencies without declining the advantage of a conventional antenna which such as downsizing of the antenna (more precisely, reduction in the thickness).

Figure 7A:
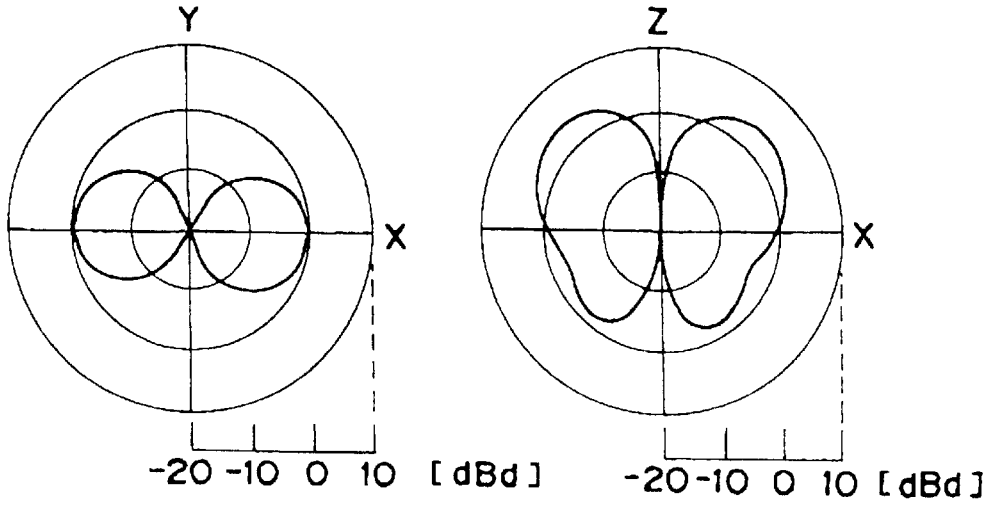
FIG. 7 illustrates a radiation directivity of the antenna.
Figure 7B:
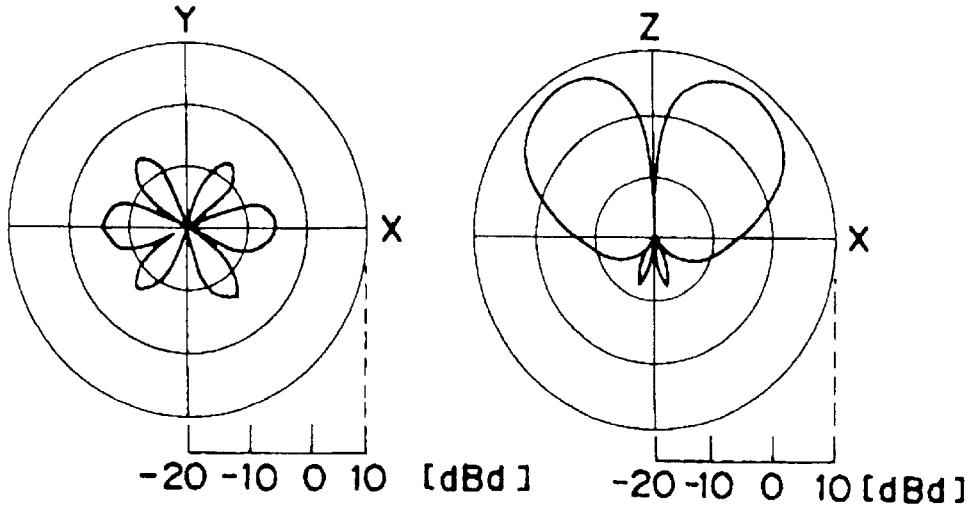

FIG. 7 illustrates patterns of the directivity of the antenna 10. FIG. 7A shows radiation directivity at f1 while FIG. 7B shows radiation directivity at f2. The scale of the directivity is expressed 10 dBd per space. The unit dBd is based on the gain of a dipole antenna. The gain of the antenna to the radiation power of a given point wave source may be expressed by dBi (=−2.15 dBd). As shown in FIG. 7A, the directivity on the XY-plane at f1 is measured with the radiation of electric wave along the Y-axis diminished but intensified along the X-axis. On the other hand, as shown in FIG. 7B, the directivity on the XY-plane at f2 is measured with the radiation of electric wave along the Y-axis diminished but intensified in six particular directions. This is explained by the antenna 10 having a depth of 1.43×λ2 (0.56×λ1) and the equivalent electromagnetic source, described with FIG. 3B, producing higher than one wavelength, thus yielding grading lobes.

Also, the antenna 10 radiates electric waves towards the upper side but hardly the bottom surface, particularly exhibiting a greater level of the directivity in transverse directions. The side conductors 14 and the grounding conductor 11 arranged about the antenna element 13 inhibit the radiation towards the bottom surface or in the −Z direction. The antenna 10 having the above described advantage will highly be favorable for use in a long, narrow indoor space such as a corridor.

Moreover, as the antenna 10 has the two openings 16 and 17 provided in the top surface thereof for radiating electric waves and the antenna element 13 surrounded as a radiation source by the grounding conductor 11 and the side conductors 14, the radiation will be minimum in the effect along the side directions and the lower direction thereof (i.e. the positional environment). More specifically, while the antenna 10 is mounted to an installation site such as on the ceiling, it is embedded in he ceiling with the top surface substantially flushed with the surface of the ceiling. This allows no projecting object to extend out from the installation surface, thus contributing to less visibility and favorable appearance of the antenna. Also, even if the antenna is hardly embedded in the installation site, the projecting object from the installation surface can be minimized thus being less visible.

Furthermore, as the antenna 10 is configured symmetrical about each of the two orthogonal planes (the ZY-plane and the ZX-plane), the radiation directivity can be symmetrical about each of the two planes.

As set forth above, the antenna 10 of the first embodiment of the present invention has a relatively simple, small structure which can perform a resonant action at two different frequencies and produce a desired directivity.

The antenna 10 of the first embodiment is not limited to the symmetrical structure about each the ZY-plane and the ZX-plane which is described previously. For acquiring a desired radiation directivity or a desired input impedance, the antenna may be arranged in symmetrical about only the ZY-plane or not symmetrical about both the ZY-plane and the ZX-plane. Also, the openings 16 and 17 for radiation of electric waves or the grounding conductor 11 or the ceiling conductor 15 or the side conductor 14 may be symmetrical about only the ZY-plane or about both the ZY-plane and the ZX-plane. Alternatively, any combination of the above structures may be made. As the structure of the antenna is symmetrical, the radiation directivity can be optimized at a radiation space.

The frequency selectable circuit 19 in the first embodiment is not limited to the LC parallel circuit which is described previously. For acquiring a desired characteristic, the frequency selectable circuit 19 may be implemented by a low-pass filter or a changeover switch. The low-pass filter produces a sharper response of the frequency at both conduction and non-conduction modes than the LC parallel circuit, hence allowing selection from closely different frequencies. On the other hand, the changeover switch permits the antenna to operate at different operation frequencies which are different in the time division mode. In the latter case, band-rejection filters for the other frequencies than the selected frequency can be omitted or minimized.

The antenna of the first embodiment is not limited to the grounding conductor 11, the side conductors 14, and the ceiling conductor 15 electrically connected to each other in the first embodiment. For acquiring a desired radiation directivity or a desired input impedance, the antenna may be modified with the ceiling conductor 15 electrically isolated from the side conductors 14 or the grounding conductor 11 electrically isolated from the side conductors 14 or the grounding conductor 11, the side conductors 14, and the ceiling conductor 15 electrically isolated from each other.

The antenna of the first embodiment is not limited to the two openings 16 and 17 provided therein which are described previously. For acquiring a desired radiation directivity or a desired input impedance, the antenna may have a single opening or three or more openings provided in the top surface thereof.

The antenna of the first embodiment is not limited to the rectangular shape of the two openings 16 and 17 which is described previously. For acquiring a desired radiation directivity or a desired input impedance, the antenna may be modified with the shape of each opening designed of a circular, square, polygonal, oval, or semi-circular shape, or their combination, or an annular shape, or any other appropriate shape. When the opening is arranged of a circular, oval, or curved shape, the conductor of the antenna has a minimum of corners thus diminishing the generation of diffraction. As a result of the improved directivity, the antenna can be minimized in the crossed polarization conversion loss of electric wave.

The antenna of the first embodiment is not limited to the two openings 16 and 17 provided in the top surface thereof which are described previously. For acquiring a desired radiation directivity or a desired input impedance, the antenna, the antenna may be modified with the openings provided in the side conductors 14 or the grounding conductor 11 or their appropriate combination.

The antenna of the first embodiment is not limited to the grounding conductor 11 and the ceiling conductor 15 provided of a rectangular shape which are described previously. For acquiring a desired radiation directivity or a desired input impedance, the antenna, the antenna may be modified with the grounding conductor 11 and the ceiling conductor 15 provided of a polygonal shape, a semi-circular shape, or any other appropriate shape. When the shape of the grounding conductor 11 and the ceiling conductor 15 is circular, oval, or curved to have a minimum of corners, the antenna can produce less diffraction and thus minimize the crossed polarization conversion loss of electric waves.

In case that the antenna is mounted to a setting surface such as a ceiling, the structure may be desired to match with the design, e.g. a chessboard pattern, of the ceiling or the shape of a room. The rectangular or polygonal shape of the antenna confines the installation and directivity to a level of limitations. When the antenna is equipped at the bottom with the grounding conductor of a circular shape, it can be installed to the ceiling without particularly concerning the design of the ceiling or the shape of the room.

Also, the antenna of the first embodiment is not limited to the side conductors 14 arranged vertical to the grounding conductor 11 which is described previously. For acquiring a desired radiation directivity or a desired input impedance, the antenna, the antenna may be modified with the side conductors 14 arranged at a specific angle to the grounding conductor 11.

The antenna of the first embodiment is not limited to the side conductors 14 arranged along the contour of the grounding conductor 11 which is described previously. For acquiring a desired radiation directivity or a desired input impedance, the antenna may be modified with the side conductors sized greater or smaller than the grounding conductor or the ceiling conductor.

Figure 9:
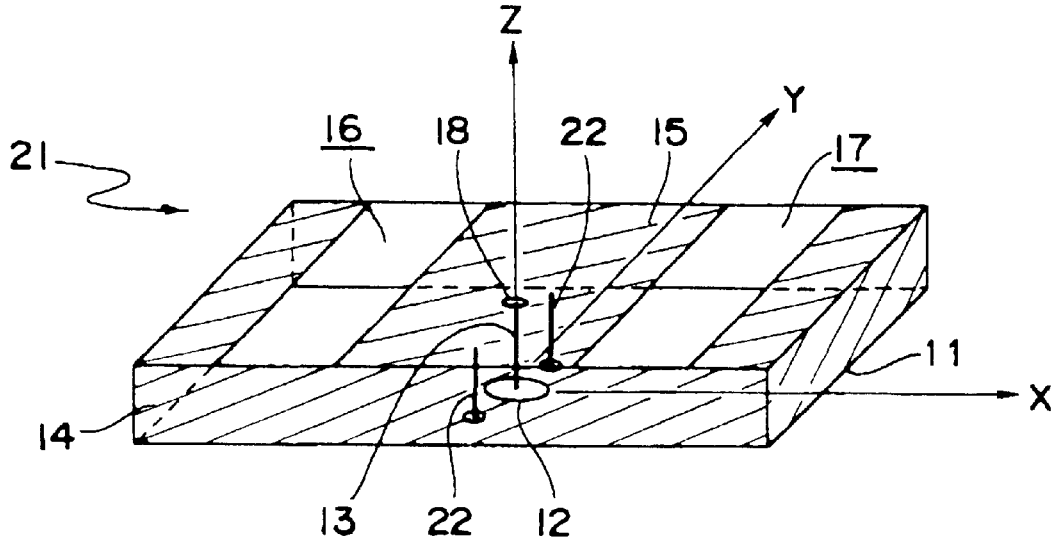
FIG. 9 illustrates a modification of the antenna according to the first embodiment where a pair of matching conductors is provided on the grounding conductor.
Figure 10:
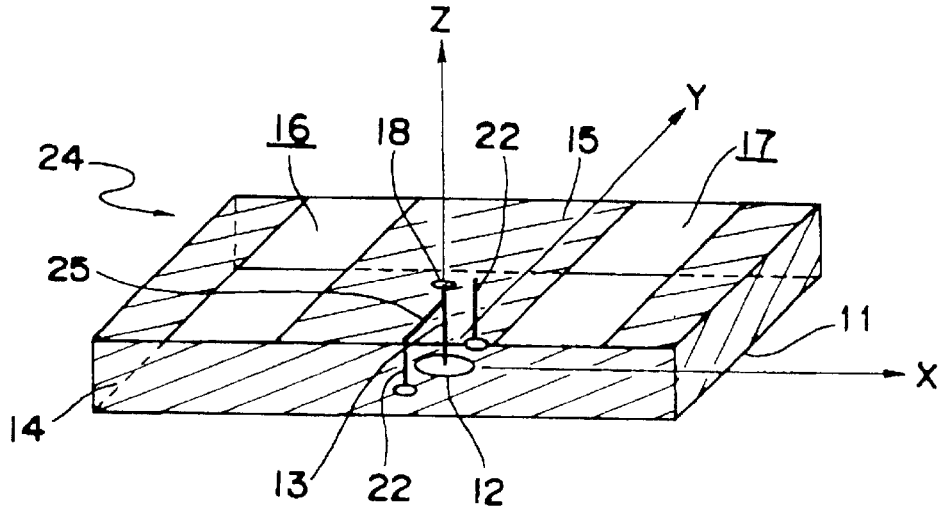
FIG. 10 illustrates a modification of the antenna where the antenna element is connected to the matching conductor via a conductor.

It may happen that the first and second resonant frequencies f1 and f2 in the antenna of the first embodiment fail to have a favorable level of impedance matching. This can be compensated by an antenna 21 shown in FIG. 9. The antenna 21 includes a pair of matching conductors 22 provided on the grounding conductor 11 in addition to the configuration of the antenna 10 of the first embodiment. As a result, the impedance of the antenna 21 can be matched with the impedance of a feeding line (not shown). In case that the impedance is too low, the matching conductor 22 is connected via a conductor 25 to the antenna element 13 as shown in an antenna 24 of FIG. 10. Accordingly, the impedance can be increased and the impedance matching can be improved.

Figure 11:
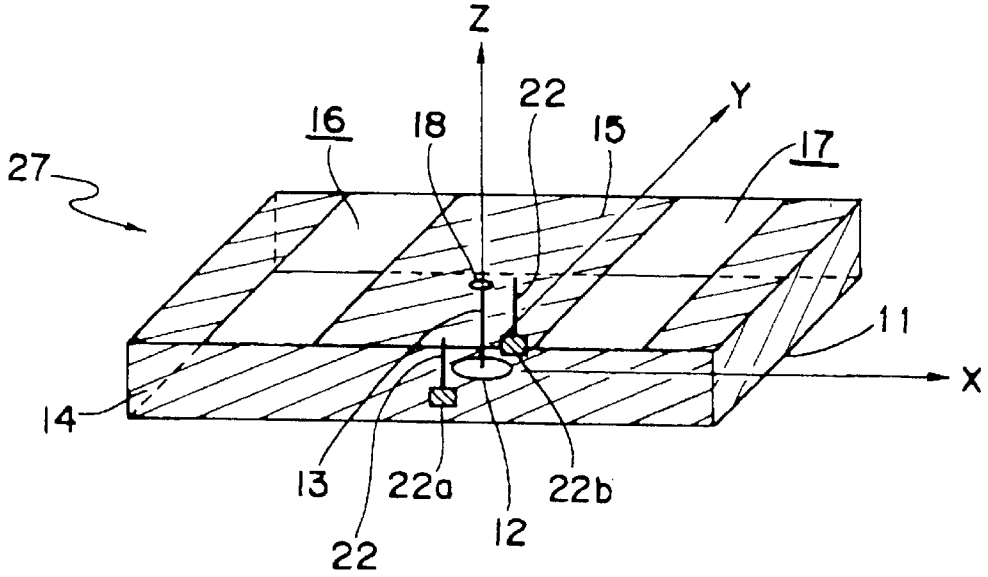
FIG. 11 illustrates a modification of the antenna where the matching conductors are connected via corresponding frequency selectable circuits to the grounding conductor.

It maybe desired that the impedance at f1 or f2 is modified depending on a combination of two frequencies. For the purpose, an antenna 27 is proposed as shown in FIG. 11. The antenna 27 has two matching conductors 22 connected by frequency selectable circuit 22*a* and 22*b* respectively to the grounding conductor 11. This enables the impedance modification at f1 or f2. More specifically, the impedance at f1 is desired for modification or at f2 remains unchanged, the frequency selectable circuits 22*a* and 22*b* are controlled to lower the resistance at f1 and disconnected at f2. In the reverse, when the impedance at f2 is modified or at f1 remains unchanged, the frequency selectable circuits 22*a* and 22*b* are controlled to lower the resistance at f2 and disconnected at f1.

Figure 12:
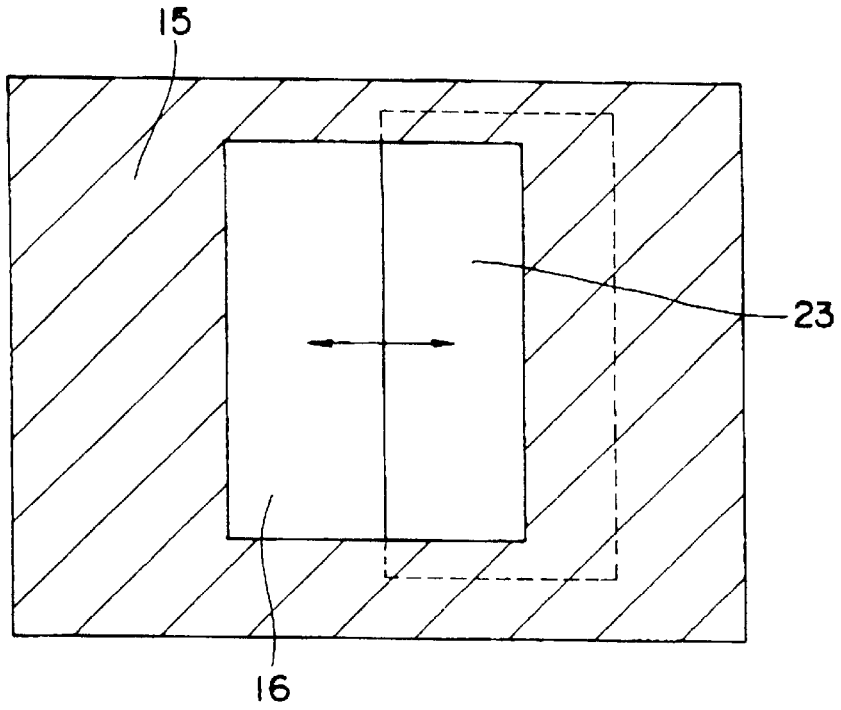
FIG. 12 illustrates an opening space variable means provided for changing the opening space.

The antenna of the first embodiment is not limited to the two openings 16 and 17 of a uniform size which is described previously. The antenna may be modified with an opening space variable means 23 provided for changing the size of the openings 16 and 17, as shown in FIG. 12. The opening space variable means 23 is a conductive sheet which can be slid over the openings 16 and 17. The sliding movement of the conductive sheet can determine the size of the openings 16 and 17. As a result, the radiation directivity of the antenna can be modified to a desired pattern.

The antenna element 13 in the antenna 10 of the first embodiment is a linear conductor but may be implemented by another arrangement. For example, the antenna element is a helical antenna made of a spiral form of the conductor. As the antenna element is decreased in the size and height, the antenna can be minimized in the size or particularly the height.

Figure 13:
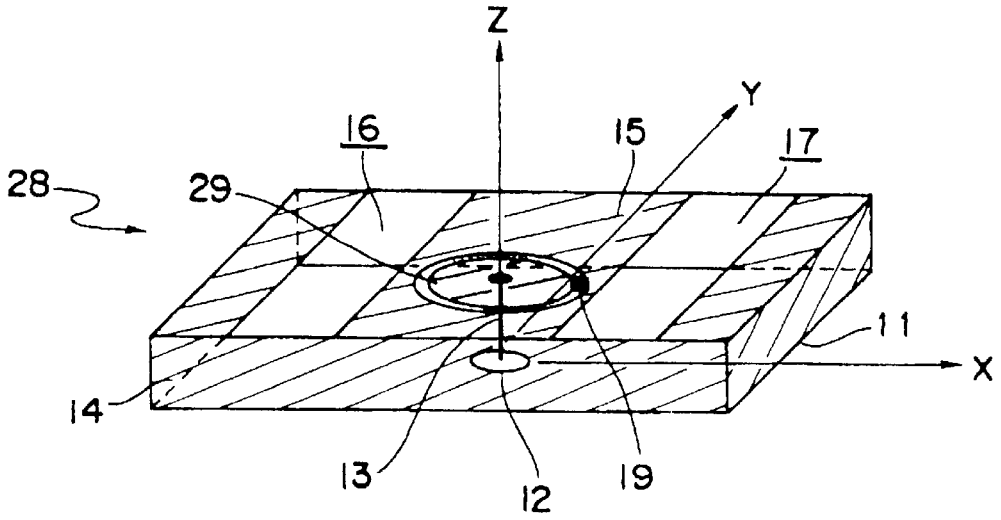
FIG. 13 illustrates a modification of the antenna where the antenna element is connected at the other end directly to a portion isolated from the other portion of the ceiling conductor, the isolated portion and the other portion being connected to each other via a frequency selector conductor.

The antenna of the first embodiment is not limited to the antenna element 13 mounted indirectly to the ceiling conductor 15 which is described previously. For example, such an antenna 28 as shown in FIG. 13 may be used. The antenna 28 is joined directly to a portion of the ceiling conductor 15 which is isolated from the other portion (as denoted by 29 and referred to as an isolated region hereinafter). The isolated portion 29 is joined to the other portion of the ceiling conductor 15 by a frequency selectable circuit 19 (as so-called a top loading type). This allows the resonant frequency to be modified to a desired level.

A plurality of the antennas 10 of the first embodiment may be arrayed thus constituting a phased array antenna or an adaptive antenna array. This arrangement can be controlled more precisely in the radiation directivity.

It is noted that the foregoing modifications of the first embodiment may be applicable to the second to tenth embodiments explained below.

The other embodiments of the present invention will now be described. Throughout the drawings, same components are denoted by same numerals as those of the first embodiment and will be explained in no more detail.

Second Embodiment

Figure 14:
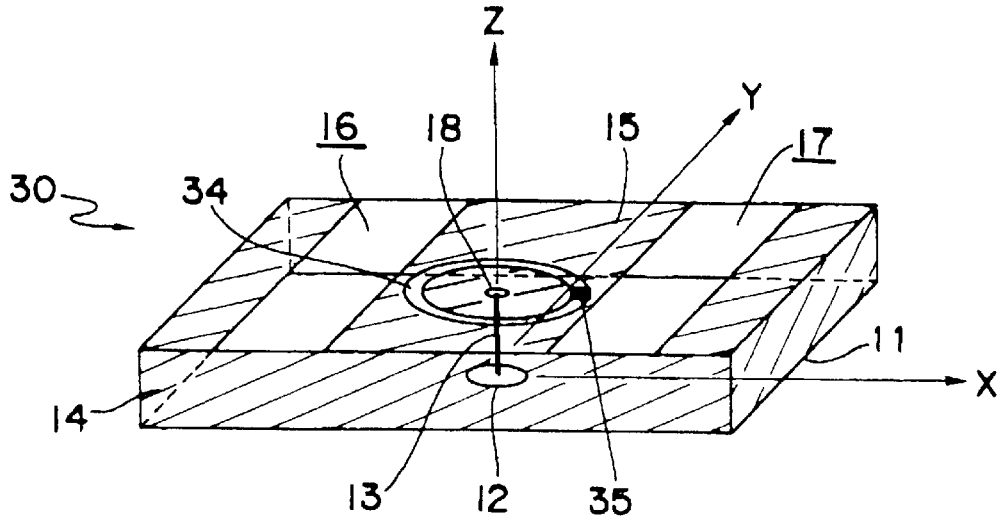
FIG. 14 illustrates a configuration of an antenna according to the second embodiment of the present invention.

FIG. 14 is a perspective view of a configuration of an antenna according to the second embodiment of the present invention.

The antenna 30 is substantially identical in the configuration to the antenna 10 of the first embodiment. The antenna 30 of the second embodiment has a substantially annular slit 34 provided in the ceiling conductor 15 there about the joint between the antenna element 13 and the ceiling conductor 15. The inner edge and the outer edge at the slit 34 of the ceiling conductor 15 are connected to each other by a frequency selectable circuit 35. A feeder 18 is identical to that of the antenna 10 of the first embodiment as illustrated in FIG. 2.

The antenna 30 as same as the antenna of the first embodiment operates at different frequencies (three frequencies in the second embodiment). It is assumed for ease of description of the action of the antenna 30 that a comparative antenna is provided with the frequency selectable circuits 19 and 35 replaced by a conductor (referred to as an antenna A hereinafter) and the operating resonant frequency is f1. Also, another comparative antenna is provided with the frequency selectable circuit 35 eliminated (referred to as an antenna B) and the resonant frequency is f2. A further comparative antenna is provided with the frequency selectable circuit 19 eliminated (referred to as an antenna C) and the resonant frequency is f3.

Those frequencies are ordered from the smallest f1 to f2 and f3. The antenna C is equivalent to a modification of the antenna A where electrical capacities are coupled in series to each other by the gap 20 between the antenna element 13 and the ceiling conductor 15. This permits the antenna C to have a resonant frequency different from that of the antenna A. The antenna B is equivalent to a modification of the antenna A where electrical capacities are coupled in series to each other by the slit 34 in the ceiling conductor 15. Accordingly, when the size of the slit 34 is changed, i.e. the size of the inner portion of the ceiling conductor 34 is changed, the resonation can be performed at a desired frequency f2 between f1 and f3. The antennas A, B, and C have different resonant frequencies each other.

Preferably, the frequency selectable circuit 35 produces a low impedance at f1 and a high impedance at f2. The frequency selectable circuit 19 produces a low impedance at f1 or f2 and a high impedance at f3. The antenna 30 with the two different frequency selectable circuits 19 and 35 can thus be operated at three different frequencies f1, f2, and f3.

Similarly, the two openings 16 and 17 are provided in the top surface of the antenna 30 for radiation of electric waves while the antenna element 13 is surrounded by the grounding conductor 11 and the side conductors 14. This permits the effect of radiation to be minimized in the side and lower directions of the antenna 30 (towards the environment). More particularly, for installation at a specific location such as the ceiling of a room, the antenna 30 is embedded in the ceiling with the top surface facing the radiation space and thus flush with the ceiling surface. As a result, the antenna 30 exhibits no projecting object on the ceiling and can be less noticeable. In case that the antenna 30 is hardly embedded at the installation site, the projecting object from the ceiling can be minimized hence having less visible appearance.

The antenna 30 of the second embodiment is arranged in symmetrical about each of the two orthogonal planes (the ZY-plane and the ZX-plane) and the radiation directivity can be symmetrical about each of the two planes.

As set forth above, the antenna 30 of the second embodiment of the present invention has a relatively simple, small structure which can perform a resonant action at three or more different frequencies and produce a desired directivity.

Third Embodiment

Figure 15:
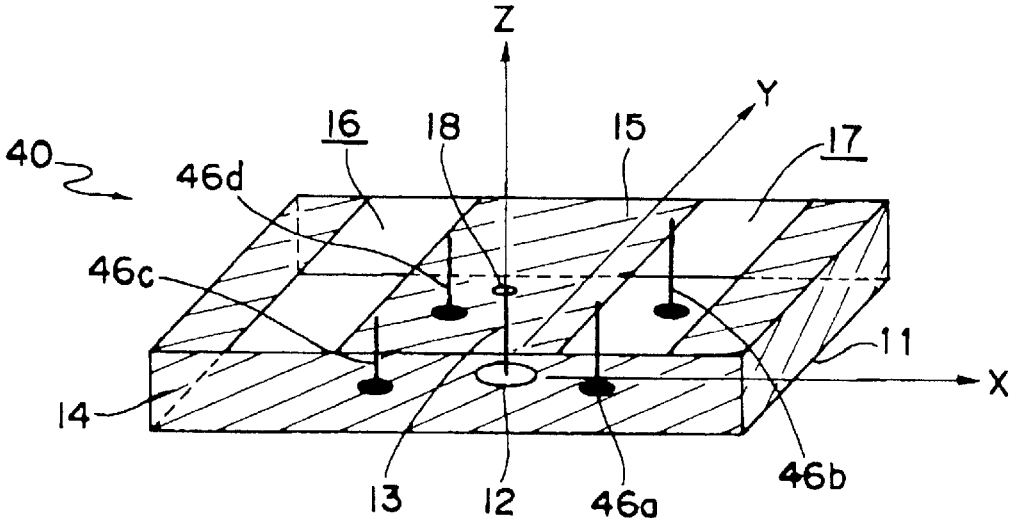
FIG. 15 illustrates a configuration of an antenna according to the third embodiment of the present invention.

FIG. 15 is a perspective view of a configuration of an antenna according to the third embodiment of the present invention. The antenna denoted by 40 is substantially identical in the configuration to the antenna 10 of the first embodiment. In addition, the antenna 40 of the third embodiment has electric field adjusting conductors 46*a,* 46*b,* 46*c,* and 46*d* provided for changing a pattern of the electric field across the openings 16 and 17. Each of the electric field adjusting conductors 46*a,* 46*b,* 46*c,* and 46*d* is connected at one end to the grounding conductor 11 and at the other end to the ceiling conductor 15. The action of the antenna 40 is similar to that of the antenna 10 of the first embodiment.

The antenna 10 of the first embodiment may produce grading lobes in the XY-plane directivity when the frequency is f2. When the XY-plane directivity is utterly different between f1 and f2, the installation of the antenna for the directivity at f1 may not be uniform with that for the directivity at f2. This impairs the advantage of the antenna 10 which operates at different frequencies. For compensation, the antenna 40 of this embodiment includes the electric field adjusting conductors 46*a,* 46*b,* 46*c,* and 46*d* in order to diminish the grading lobes produced at f2. As the distribution of the electric field across the openings is changed at f2, it can successfully diminish the grading lobes thus improving the directivity at f2.

The antenna 40 may be set to the same dimensions explained in conjunction with FIG. 4 as substantially identical in the configuration to the antenna 10 of the first embodiment. The electric field adjusting conductors 46*a,* 46*b,* 46*c,* and 46*d* are $0.16\times\lambda 2$ in the height and located at their respective (four in total) positions spaced by $\pm 0.32\times\lambda 2$ along the X direction and by $\pm 0.5\times\lambda 2$ along the Y direction from the feeding point 12 or the origin on the grounding conductor 11. They are connected at the other end to the ceiling conductor 15. The frequency selectable circuit 19 at the feeder 18 may be implemented by a LC parallel circuit of which the resonant frequency is f2. The resonant frequencies of the antenna 40 are f1 and f2.

Figure 16A:
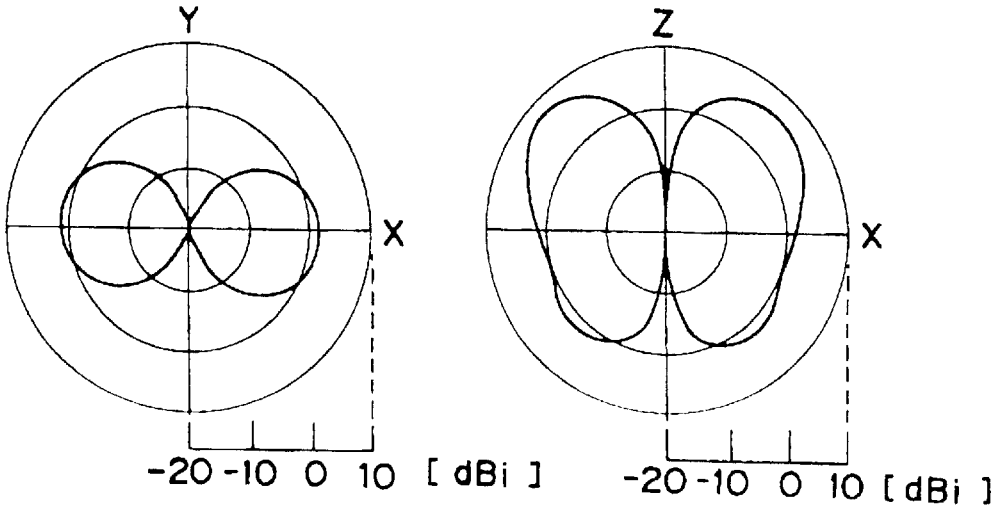
FIG. 16 illustrates a radiation directivity of the antenna of the third embodiment.
Figure 16B:
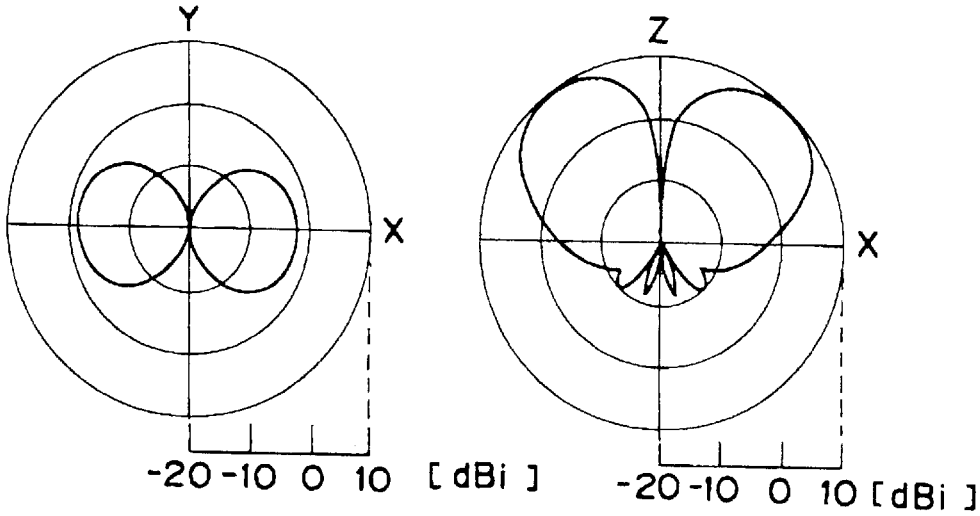

FIG. 16 illustrates patterns of the radiation directivity of the antenna 40. FIG. 16A shows the radiation directivity at f1 and FIG. 16B shows the radiation directivity at f2. The scale of the radiation directivity is expressed 10 dB per space. More particularly, the unit is dBi based on the radiation power at the point waveform source. As apparent from FIG. 16, the antenna 40 produces the radiation of electric waves at both the frequencies f1 and f2 emphasized along the X direction but diminished along the Y direction. The grading lobes at f2 can be decreased. Also, the antenna 40 produces no radiation in the lower direction but a higher intensity of radiation in the upper direction, exhibiting a higher level of the radiation directivity in oblique directions. More specifically, as the side conductors 14 and the grounding conductor 11 are provided about the antenna element 13, they can minimize the radiation in the lower or −Z direction. The antenna 40 is hence advantageous for use in a long, narrow interior space such as a corridor.

As set forth above, the antenna 40 of the third embodiment of the present invention has a relatively simple, small structure which can perform a resonant action at two or more different frequencies and produce a desired directivity. In addition, the arrangement is stable enough to diminish the grading lobes.

Fourth Embodiment

Figure 17:
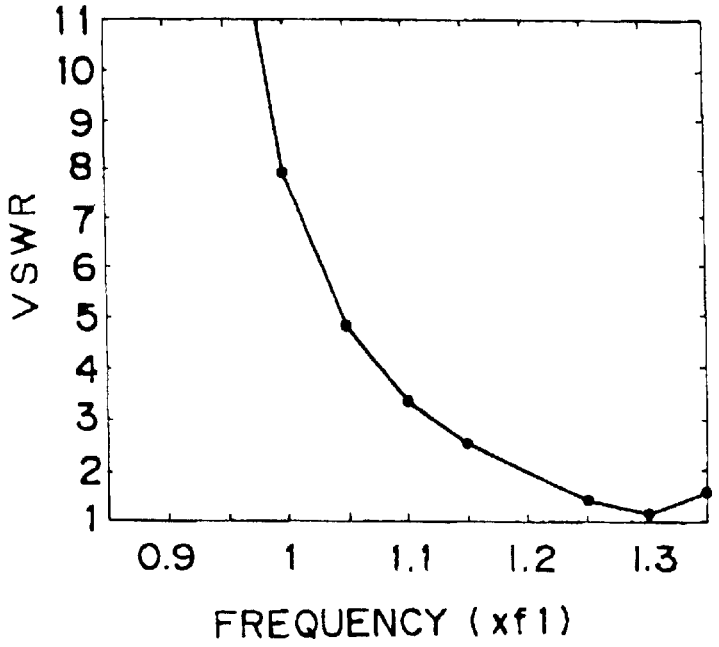
FIG. 17 illustrates an impedance profile of the antenna of the third embodiment.
Figure 18:
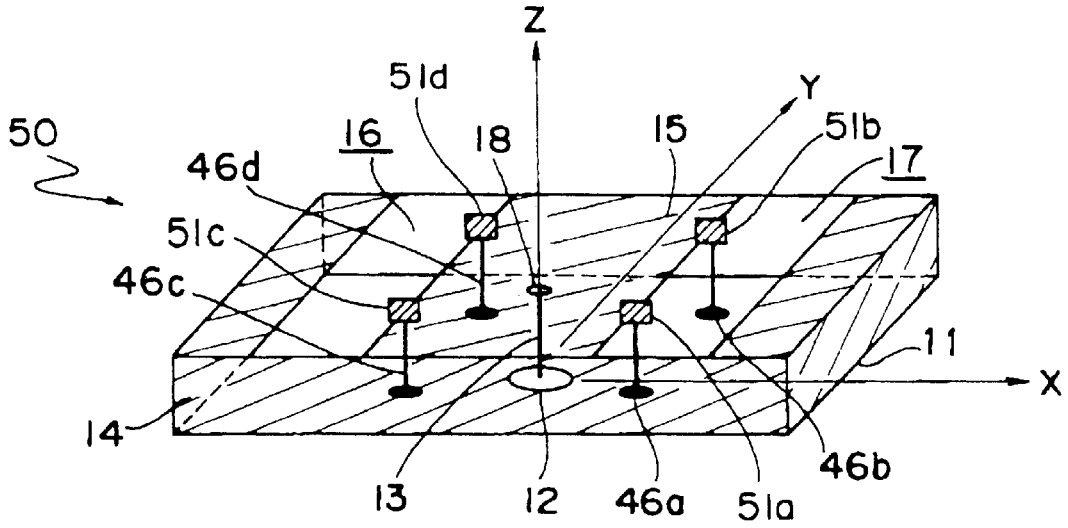
FIG. 18 illustrates an antenna according to the firth embodiment, which has an electric field adjusting conductors connected to the ceiling conductor via corresponding frequency selectable circuits.
Figure 19A:
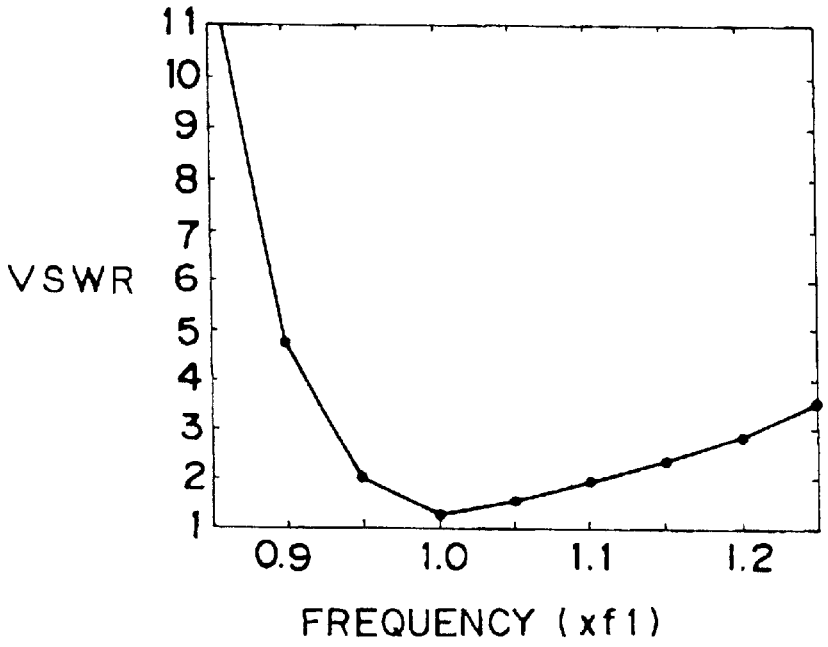
FIG. 19A illustrates an impedance profile at frequency f1 and FIG. 19B illustrates an impedance profile at frequency f2, for the antenna shown in FIG. 18.
Figure 19B:
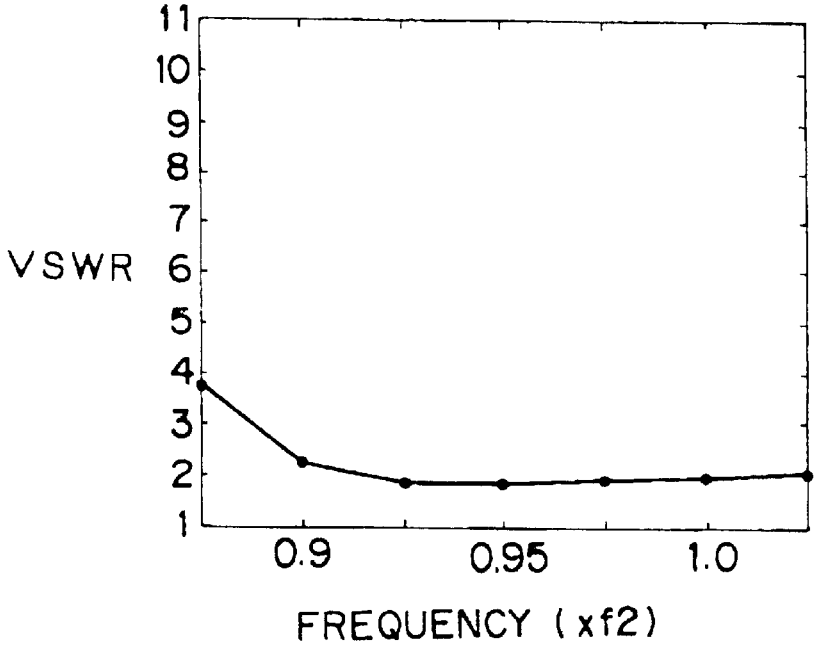

However, as apparent from FIG. 17, the resonant frequency of the antenna 40 of the third embodiment is disposed to deviate from f1. As an example to dissolve such deviation, an antenna 50 according to the fourth embodiment of the present invention is shown in FIG. 18. The antenna 50 has electric field adjusting conductors 46*a,* 46*b,* 46*c,* and 46*d* connected by frequency selectable circuits 51*a,* 51*b,* 51*c,* and 51*d* respectively to the ceiling conductor 15. This allows the resonant frequency to converge on f1, as shown in FIG. 19A. At the time, the second resonant frequency f2 remains unchanged as shown in FIG. 19B. As a result, the two frequencies can be minimized in the reflection loss hence increasing the directivity of the antenna in two opposite directions on the horizontal.

The antennas 40 and 50 are not limited to the four frequency selectable circuits 51*a,* 51*b,* 51*c,* and 51*d* connected between the corresponding electric field adjusting conductors 46*a,* 46*b,* 46*c,* and 46*d* and the ceiling conductor 15 which are described previously. The antenna may be modified where each of the frequency selectable circuits is connected between the electric field adjusting conductor and the grounding conductor 11 or between the electric field adjusting conductor and the ceiling conductor 15 and between the electric field adjusting conductor and the grounding conductor 11.

The antennas 40 and 50 are not limited to the four electric field adjusting conductors arranged in symmetrical about the feeding point which are described previously. The electric field adjusting conductors in the antenna are not limited to four and their arrangement may not be symmetrical.

Fifth Embodiment

Figure 20:
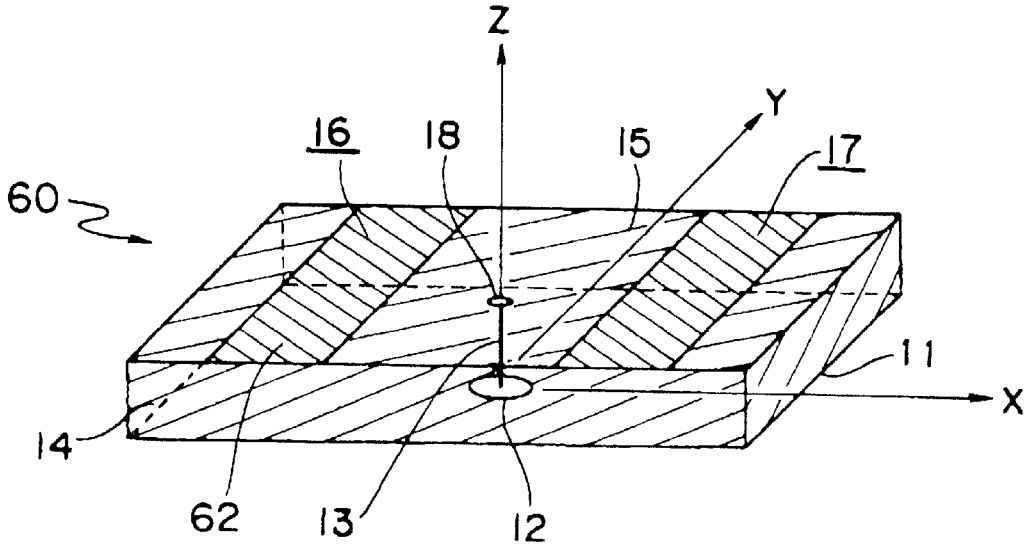
FIG. 20 illustrates a configuration of an antenna according to the fifth embodiment of the present invention.

FIG. 20 is a perspective view of a configuration of an antenna according to the fourth embodiment of the present invention. The antenna denoted by 60 is substantially identical in the configuration to the antenna 10 of the first embodiment. The antenna 60 of the fourth embodiment further comprises a dielectric 62 filled in the inner space defined by the grounding conductor 11, the side conductors 14, and the ceiling conductor 15. The action of the antenna 60 is similar to that of the antenna 10 of the first embodiment.

It may be desired that the antenna 10 of the first embodiment is further reduced in the height to have a less noticeable appearance. As the antenna 60 of the fourth embodiment has the dielectric filled in the space defined by the grounding conductor 11, the side conductors 14, and the ceiling conductor 15, the height or size can be minimized. Assuming that the ratio of dielectric constant between the vacuum ($\epsilon 0$) and the dielectric (specific dielectric constant) is $\epsilon r$, the wavelength in the dielectric is $1/\sqrt{(\epsilon r)}$ times greater than that in the vacuum. As $\epsilon r$ is higher than 1, the wavelength is reduced in the dielectric. Accordingly, the antenna can be minimized in the height or size.

The antenna 60 can be protected from moisture or dusty air flowing into through the openings 16 and 17, hence avoiding any deterioration in the antenna characteristics and solidly maintaining the operational reliability for a long period.

The ceiling conductor 15 and the grounding conductor 11 may be implemented by a pattern of a metal material developed on a dielectric substrate while the side conductors 14 are made of a conductor bier. This allows the ceiling conductor 15 with the openings 16 and 17 to be fabricated by a highly precision technique such as etching, thus contributing to the improvement of fabrication accuracy and the cost reduction in mass production of the antenna.

Also, the top conductor provided with the openings 16 and 17 may be made of a dielectric board. More specifically, the dielectric board is covered at one side with a metal foil which acts as a conductor while the absent portions are the openings 16 and 17. The dielectric board serves as a cover for inhibiting moisture or dusty air from coming into the antenna, hence minimizing declination in the properties and maintaining the operational reliability throughout a long period. Moreover, as the conductor and openings are fabricated by a highly precision technique such as etching, the antenna can be improved in the dimensional accuracy and reduced in the cost in mass production. Since the space defined by the grounding conductor 11, the side conductors 14, and the ceiling conductor 15 is not completely filled with the dielectric, the antenna will be less weighted.

Sixth Embodiment

Figure 21:
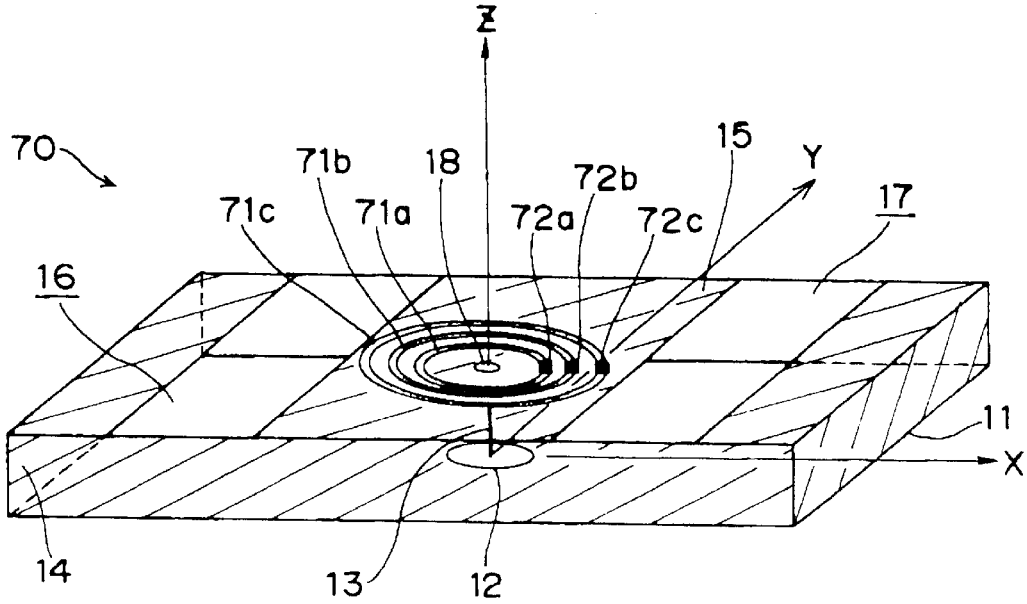
FIG. 21 illustrates a configuration of an antenna according to the sixth embodiment of the present invention.

FIG. 21 is a perspective view of a configuration of an antenna according to the sixth embodiment of the present invention.

The antenna denoted by 70 is substantially identical in the configuration to the antenna 30 of the second embodiment. In particular, the antenna 70 of the sixth embodiment has a plurality of generally annular slits 71*a,* 71*b,* and 71*c* provided in the ceiling conductor 15 thereof concentrically about the distal end of the antenna element 13. The inner edge and the outer edge at each of the slits 71*a,* 71*b,* and 71*c* of the ceiling conductor 15 are joined to each other by one of frequency selectable circuits 72*a,* 72*b,* and 72*c.*

The configuration of a feeder 18 is equal to that of the antenna 10 of the first embodiment where the inner edge and the outer edge at the opening 15*a* of the ceiling 15 is connected by a frequency selectable circuit 19 to the antenna element 13, as shown in FIG. 2.

The antenna 70 with the above configuration including the four frequency selectable circuits 19, 72*a,* 72*b,* and 72*c* can operate at five different frequencies with the single structure. As the antenna 70 of the sixth embodiment is arranged in symmetrical about each of the two orthogonal planes (the ZY-plane and the ZX-plane), the radiation directivity can favorably be symmetrical about the two planes.

The antenna 70 of the sixth embodiment has a relatively simple, small structure which can resonate at five or more desired frequencies and produce a desired pattern of the radiation directivity.

The antenna 70 of the sixth embodiment is not limited to three pairs of the annular opening and the frequency selectable circuit provided on the ceiling conductor for giving the five resonant frequencies. A more number of pairs of the opening and the frequency selectable circuit may be provided for permitting the antenna to resonate at more different frequencies.

Seventh Embodiment

Figure 22:
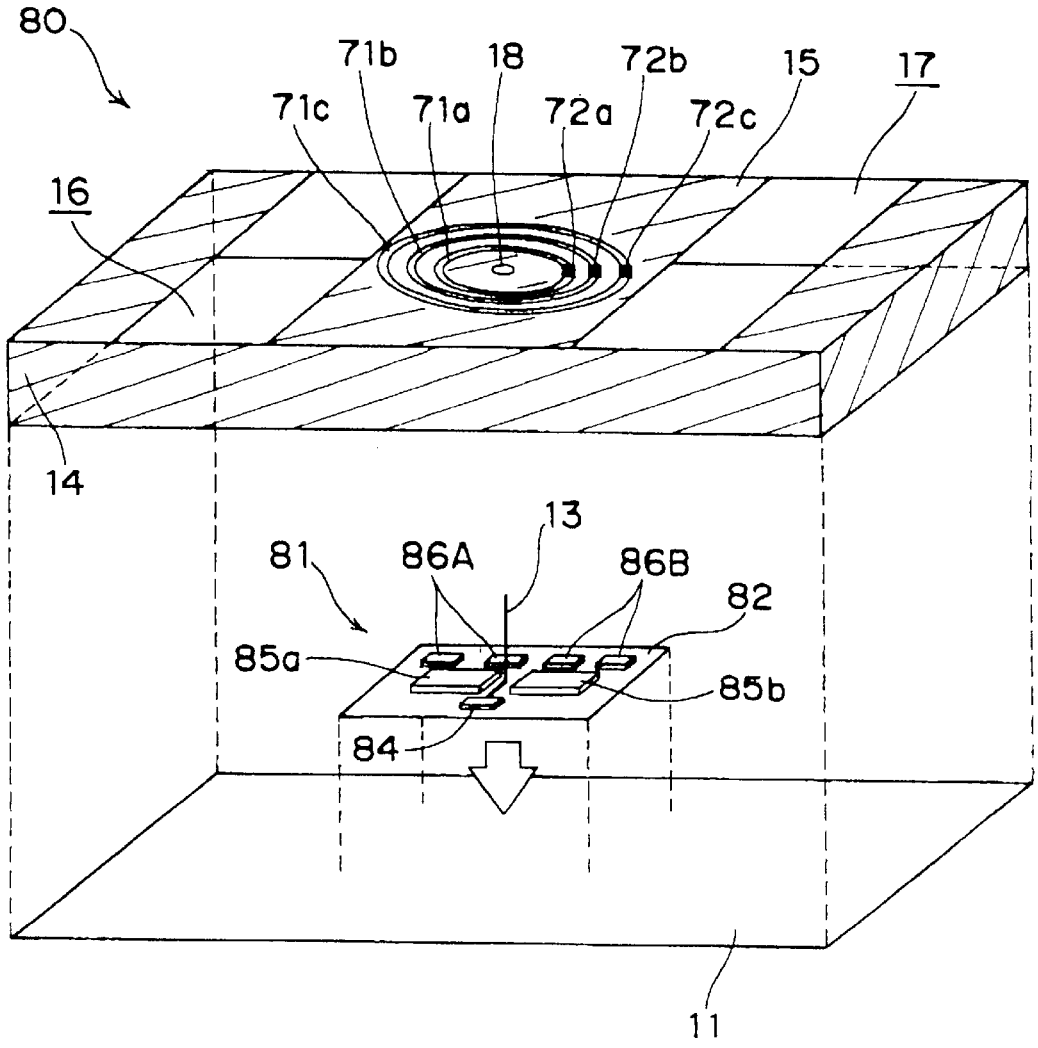
FIG. 22 illustrates a configuration of an antenna according to the seventh embodiment of the present invention.

FIG. 22 is perspective view of an assembled structure of an antenna according to the seventh embodiment of the present invention. The antenna denoted by 80 is substantially identical in the structure of the ceiling conductor 15 to that of the sixth embodiment. The antenna 80 of the seventh embodiment also includes a transmission/reception circuit 81 for transmitting and receiving signals of a specific frequency or frequency band. The transmission/reception circuit 81 is composed of various components and a circuit board 82 on which the components are mounted, and is arranged on the grounding conductor 11 by attaching said circuit board 82 to the grounding conductor 11. The antenna element 13 is provided on the transmission/reception circuit 81 as extends upwardly from the circuit board 82 to substantially the center of the feeder 18.

Figure 23:
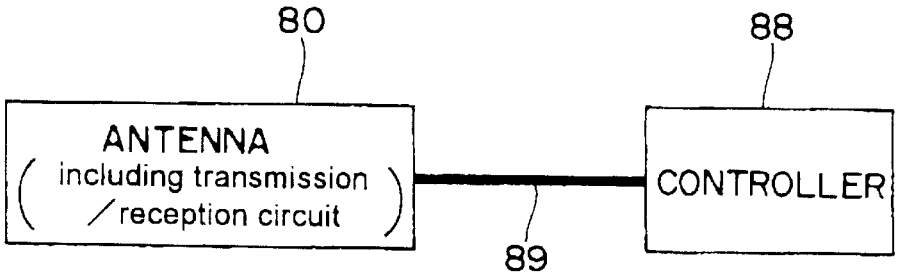
FIG. 23 illustrates the antenna and a controller connected to each other via a signal transmission cable.

The antenna 80 equipped with the transmission/reception circuit 81 is connected via a signal transmission cable 87 to a controller 88 for processing a base band signal as shown in FIG. 23. The controller 88 basically demodulates a high frequency signal received by antenna 80 and extracts a baseband signal from the high frequency signal. On the other hand, the controller 88 modulates the base band signal for its amplitude, frequency, or phase and transmits the modulated signal to the antenna 80.

Figure 24:
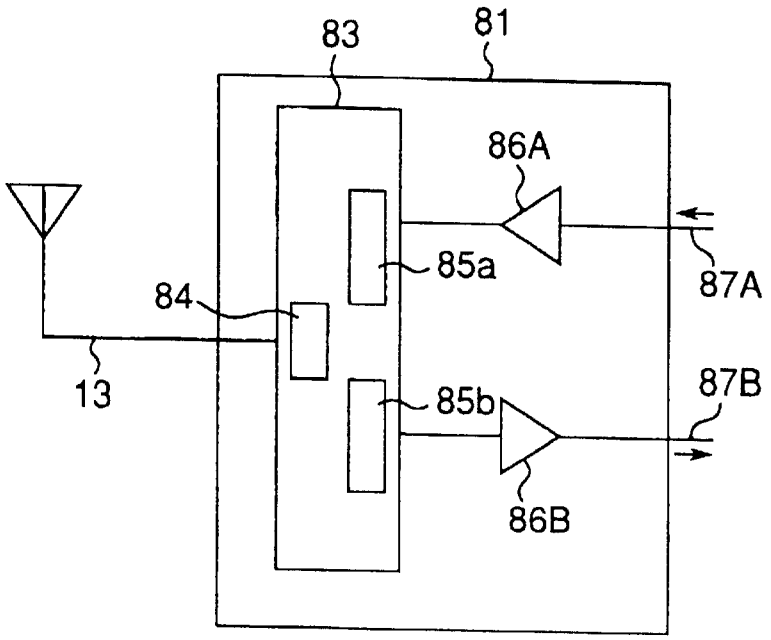
FIG. 24 is a block diagram of a transmission/reception circuit provided in the antenna according to the seventh embodiment.

FIG. 24 illustrates a configuration of the transmission/reception circuit 81. The transmission/reception circuit 81 comprises a filter switching circuit 83 including a filter switch 84 and two filters 85*a* and 85*b* which are different from each other in the passing frequency band, a amplifier 86A for transmission, and a amplifier 86B for reception. The antenna element 13 linked to the transmission/reception 81 is connected to the filter switch 84 in the filter switching circuit 83. In the filter switching circuit 83, the filter switch 84 switches at equal intervals between the two filters 85*a* and 85*b* so that one of filters 85*a,* 85*b* is connected with the antenna element 13. By switching action of the filter switching circuit 83, the frequency of signal to be transmitted or received is variable, and hence the antenna applicable to various frequencies or frequency bands can be accomplished.

In the transmission mode, the transmission/reception circuit 81 allows a signal supplied via the signal transmission cable 87A from the controller 88 (See FIG. 23) to be amplified by the amplifier 86A for transmission and received by the filter switching circuit 83. In the filter switching circuit 83, the received signal is filtered by one of the filters 85*a* and 85*b* selected by the filter switch 84 and a resultant passed frequency band is extracted from the received signal. The frequency band signal is then transferred to the antenna element 13.

In the reception mode, a signal received at the antenna element 13 is passed through the selected filter determined by the filter switch 84 in the filter switching circuit 83. A resultant extracted frequency band is amplified by the amplifier 86B and transferred via the signal transmission cable 87B to the controller 88 (see FIG. 23).

The transmission/reception circuit incorporated in the antenna may have an alternative configuration different from that shown in FIG. 24. For example, the transmission/reception circuit can be used, which is equipped with a high frequency IC capable of controlling the frequency or frequency band of a signal to be received or transmitted. In such transmission/reception circuit, a signal having a desired frequency is obtained by the high frequency IC. Further, referring to FIGS. 25 to 29, the examples of the configuration of transmission/reception circuit which are different from that shown in FIG. 24, will be explained.

Figure 25:
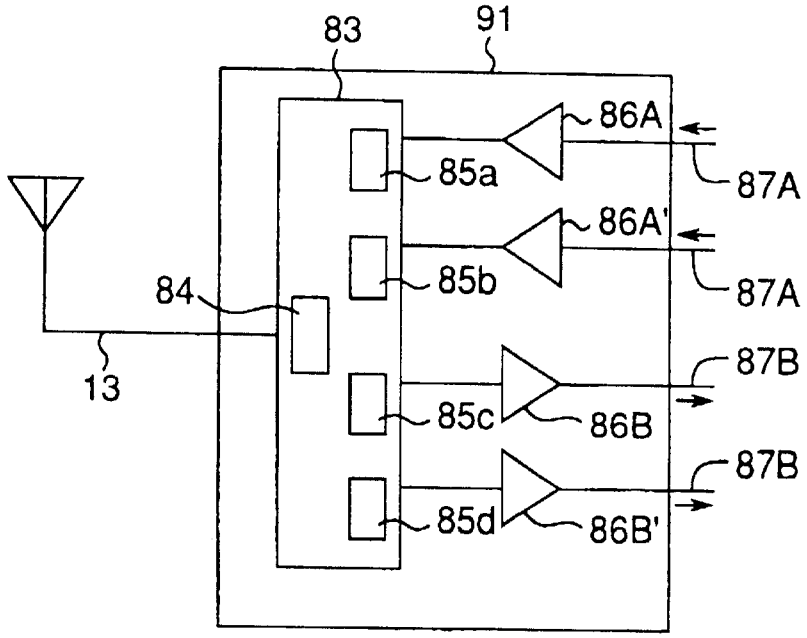
FIG. 25 illustrates a first modification for the configuration of the transmission/reception circuit different from that shown in FIG. 24.

FIG. 25 illustrates a transmission/reception circuit 81 which comprises a filter switching circuit 83 including four filters 85*a,* 85*b,* 85*c,* and 85*d* which are different in the passing frequency band, a pair of amplifiers 86A, 86A' for transmission, and a pair of amplifiers 86B, 86B' for reception. The amplifiers 86A, 86A' for transmission are different from each other in the amplifying gain. Similarly, the amplifiers 86B, 86B' for reception are different from each other in the amplifying gain. Those amplifiers 86A, 86A' for transmission and amplifiers 86B, 86B' for reception are connected to signal transmission cables 87A for transmission and signal transmission cables 87B for reception respectively.

In the transmission/reception circuit 91, by providing amplifiers different from each other in the amplifying gain for each of transmission and reception, the transmitted electric waves with various strength can be obtained in transmission, and the signal with a desired strength can be obtained from the received electric wave different from each other in the strength in reception.

It is noted that a plurality of amplifiers different from each other in the operating frequency may be used instead of amplifiers 86A, 86A' or 86B, 86B'. In this case, the transmitted or received electric waves with various frequencies can be obtained in transmission and reception.

Figure 26:
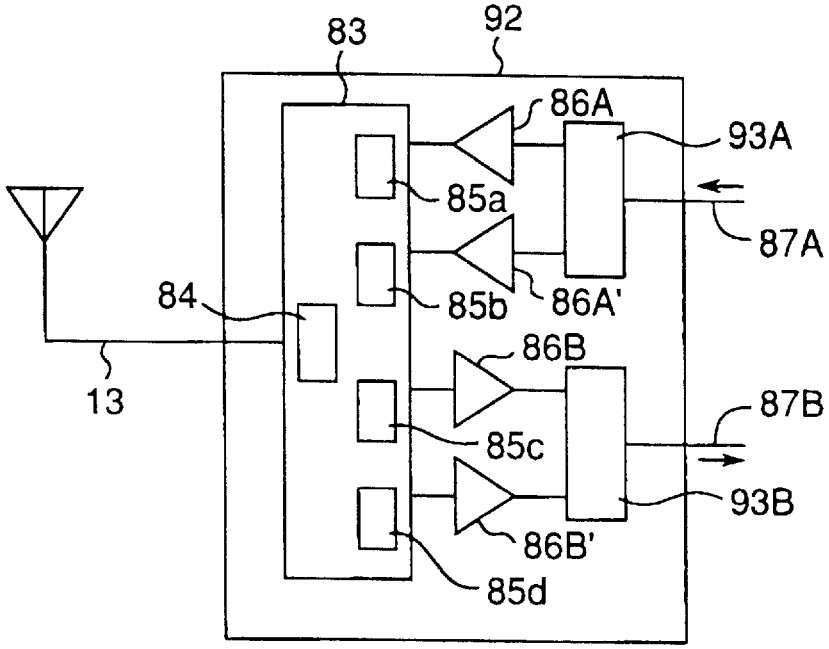
FIG. 26 illustrates a second modification for the configuration of the transmission/reception circuit different from that shown in FIG. 24.

FIG. 26 illustrates a transmission/reception circuit 92 which comprises, in addition to the configuration of the transmission/reception circuit 91 shown in FIG. 25, a signal divider 93A by which the amplifiers 86A, 86A' for transmission are connected to the signal transmission cable 87A for transmission, and a signal compositor 93B by which the amplifiers 86B, 86B' for reception are connected to the signal transmission cable 87B for reception. The signal divider 93A divides a signal received from the signal transmission cable 87A into two signals which are fed to the two amplifiers 86A, 86A' for transmission. The signal compositor 93B compounds two signals received from their respective amplifiers 86B, 86B' for reception to have a single signal.

Figure 27:
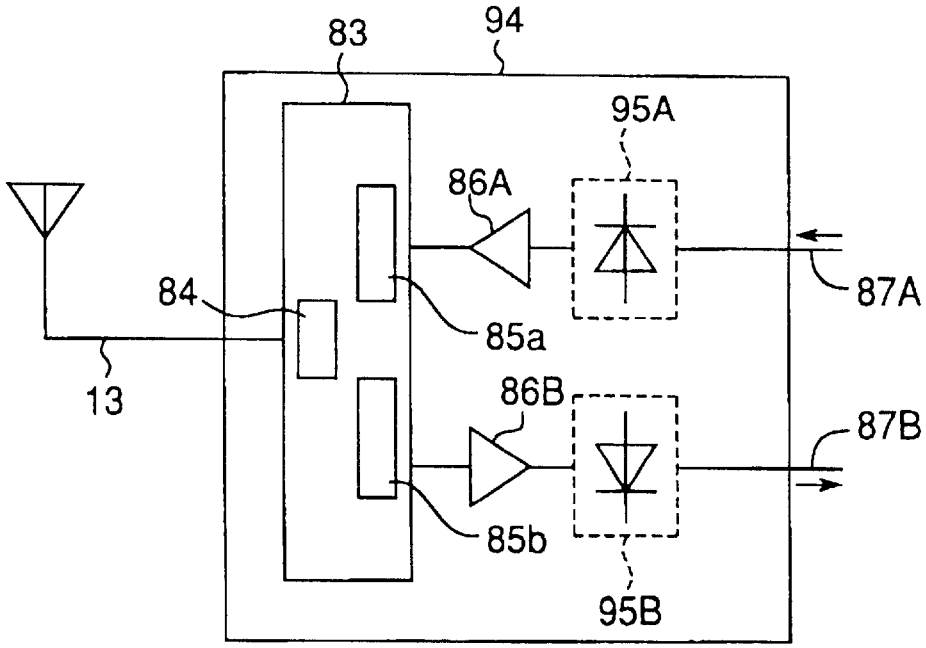
FIG. 27 illustrates a third modification for the configuration of the transmission/reception circuit different from that shown in FIG. 24.

FIG. 27 illustrates a transmission/reception circuit 94 which comprises, in addition to the configuration of the transmission/reception circuit 81 shown in FIG. 24, a photodiode 95A by which the amplifier 86A for transmission is connected to the signal transmission cable 87A for transmission, and a laser diode 95B by which the amplifier 86B for reception is connected to the signal transmission cable 87B for reception. In this modification, the signal transmission cables 87A and 87B for transmission and reception are optical fibers capable of broadband and low-loss signal transmission. A signal supplied from the optical fiber 87A is photoelectrically converted by the photodiode 95A and output to the amplifier 86A. A signal received from the amplifier 86B for reception is electrooptically converted by the laserdiode 95B and output through the optical fiber 87B. The photodiode 95A may be replaced by a phototransistor.

Figure 28:
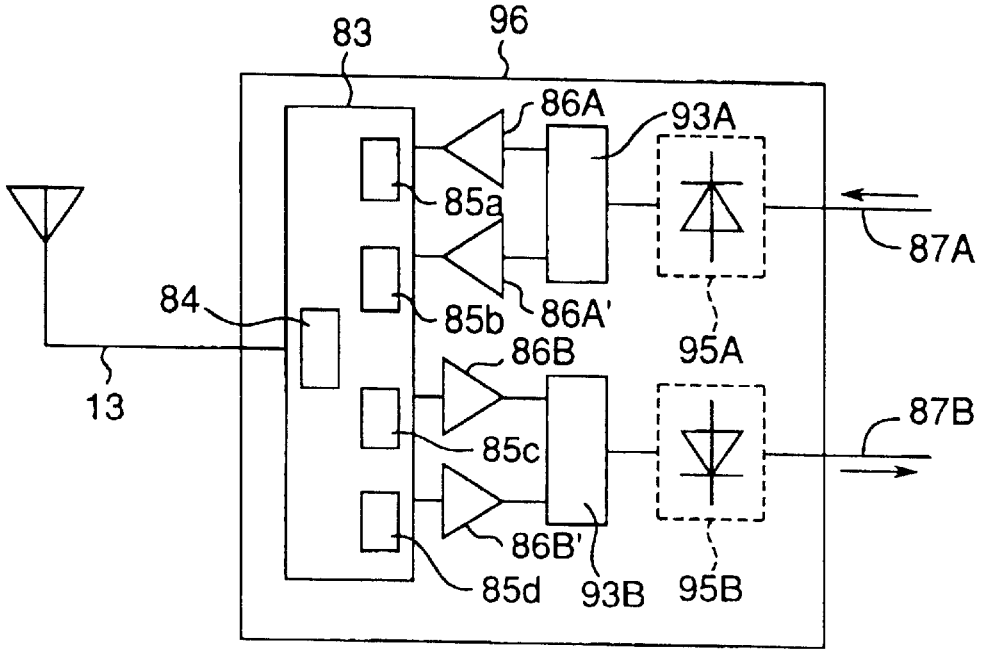
FIG. 28 illustrates a fourth modification for the configuration of the transmission/reception circuit different from that shown in FIG. 24.

FIG. 28 illustrates a transmission/reception circuit 96 which comprises, in addition to the configuration of the transmission/reception circuit 92 shown in FIG. 26, a signal divider 93A which is connected at one end to the amplifiers 86A, 86A' for transmission and at the other end to the signal transmission cable 87A for transmission via the photodiode 95A, and a signal compositor 93B which is connected at one end the amplifiers 86B, 86B' for reception and at the other end to the signal transmission cable 87B for reception via the laserdiode 95B. Similar to those shown in FIG. 26, the signal transmission cables 87A and 87B for transmission and reception are optical fibers.

Figure 29:
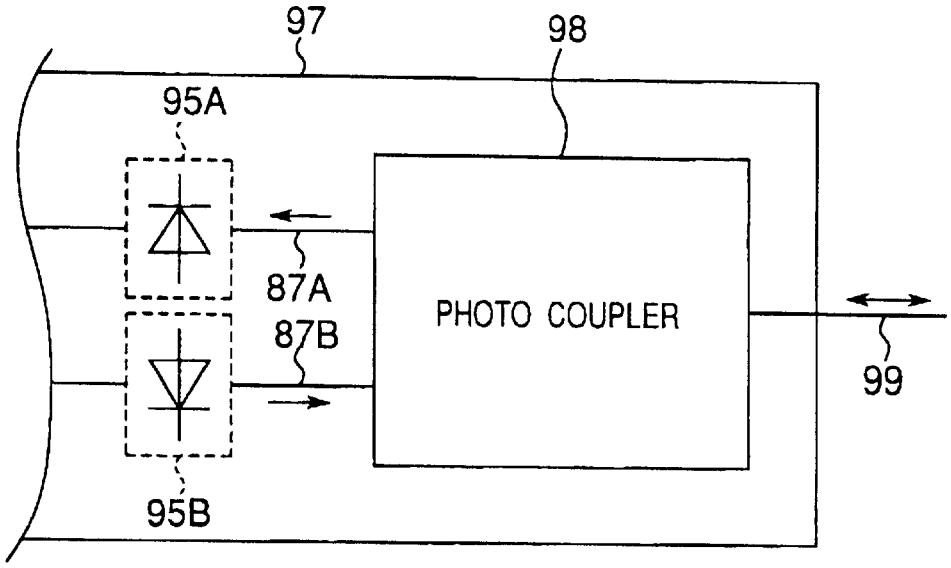
FIG. 29 illustrates a fifth modification for the configuration of the transmission/reception circuit different from that shown in FIG. 24.

FIG. 29 illustrates a transmission/reception circuit 97 where a photocoupler 98 is provided for the optical fibers 87A, 87B for transmission and reception to which the photodiode 95A and the laserdiode 95B as shown in FIGS. 27 and 28 are connected respectively. The photocoupler 98 is connected at one end to the two optical fibers 87A and 87B and at the other end to a single optical fiber 99 capable of bi-directional transmission of signals.

By providing the photocoupler 98, it allows signals to be transmitted between the controller 88 for processing baseband signals and transmission/reception circuit 97 via only single optical fiber 99, and hence the configuration of system can be simplified.

It is noted that the foregoing modifications of the transmission/reception circuit may be applicable to the eighth to tenth embodiments explained below.

Eighth Embodiment

Figure 30:
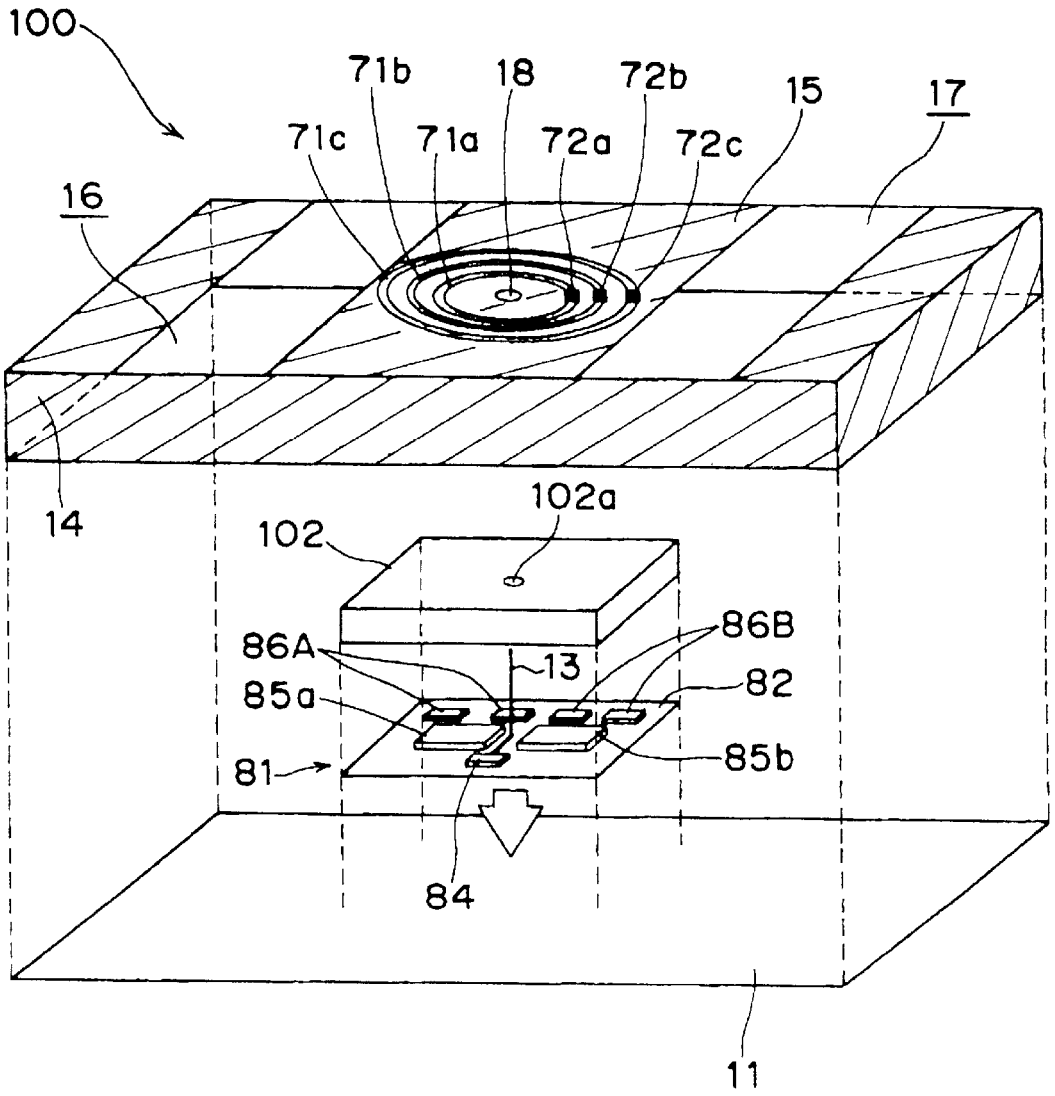
FIG. 30 illustrates an exploded view of an assembled structure of an antenna according to the eighth embodiment of the present invention.

FIG. 30 is a perspective view of an assembled structure of an antenna according to the eighth embodiment of the present invention. The antenna denoted by 100 is substantially identical in the structure to that of the seventh embodiment. The antenna 100 of the eighth embodiment has a cover member 102 provided in the chassis for shielding the transmission/reception circuit 81 mounted on the grounding conductor 11. The cover member 102 has an aperture 102*a* provided therein through which the antenna element 13 extends upwardly from the circuit board 82.

The cover member 102 protects the transmission/reception circuit 81 from hostile environmental conditions including dust and moisture. When the cover member 102 is made of a metallic material, it can inhibit any transmitted or received signal affecting on the action of the transmission/reception circuit 81.

Ninth Embodiment

Figure 31:
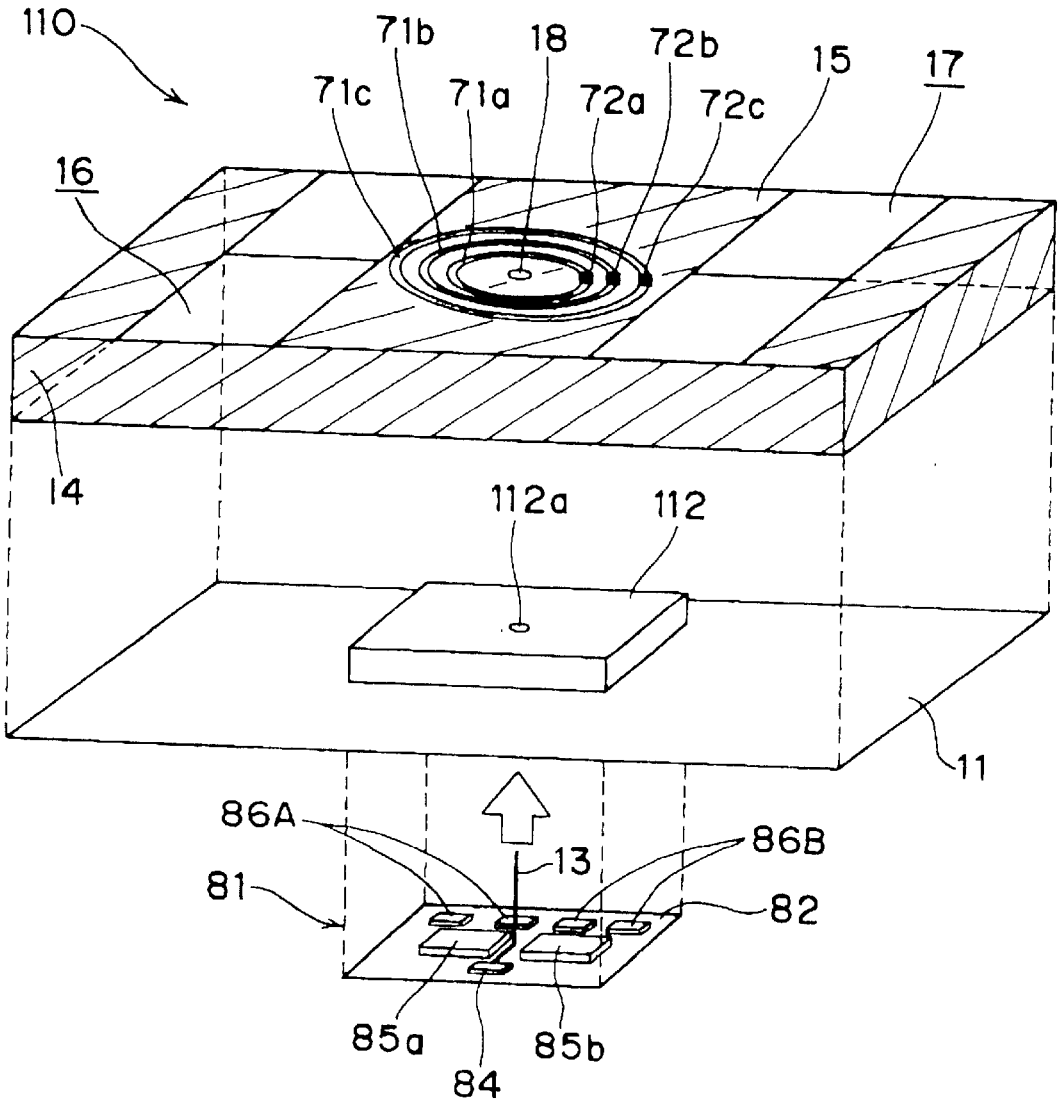
FIG. 31 illustrates an exploded view of an assembled structure of an antenna according to the ninth embodiment of the present invention.

FIG. 31 is an exploded perspective view of an assembled structure of an antenna according to the ninth embodiment of the present invention. While the transmission/reception circuit 81 is mounted on the grounding conductor 11 in the chassis according to the seventh and eighth embodiments, the antenna 110 of the ninth embodiment has a hollow protrusive portion 112 provided on the grounding conductor 11 and the transmission/reception circuit 81 is accommodated in the inner space of the hollow protrusive portion 112 as located on the lower side of the grounding conductor 11. The protrusive portion 112 has an aperture 112*a* provided therein through which the antenna element 13 extends upwardly from the circuit board 82.

Tenth Embodiment

Figure 32:
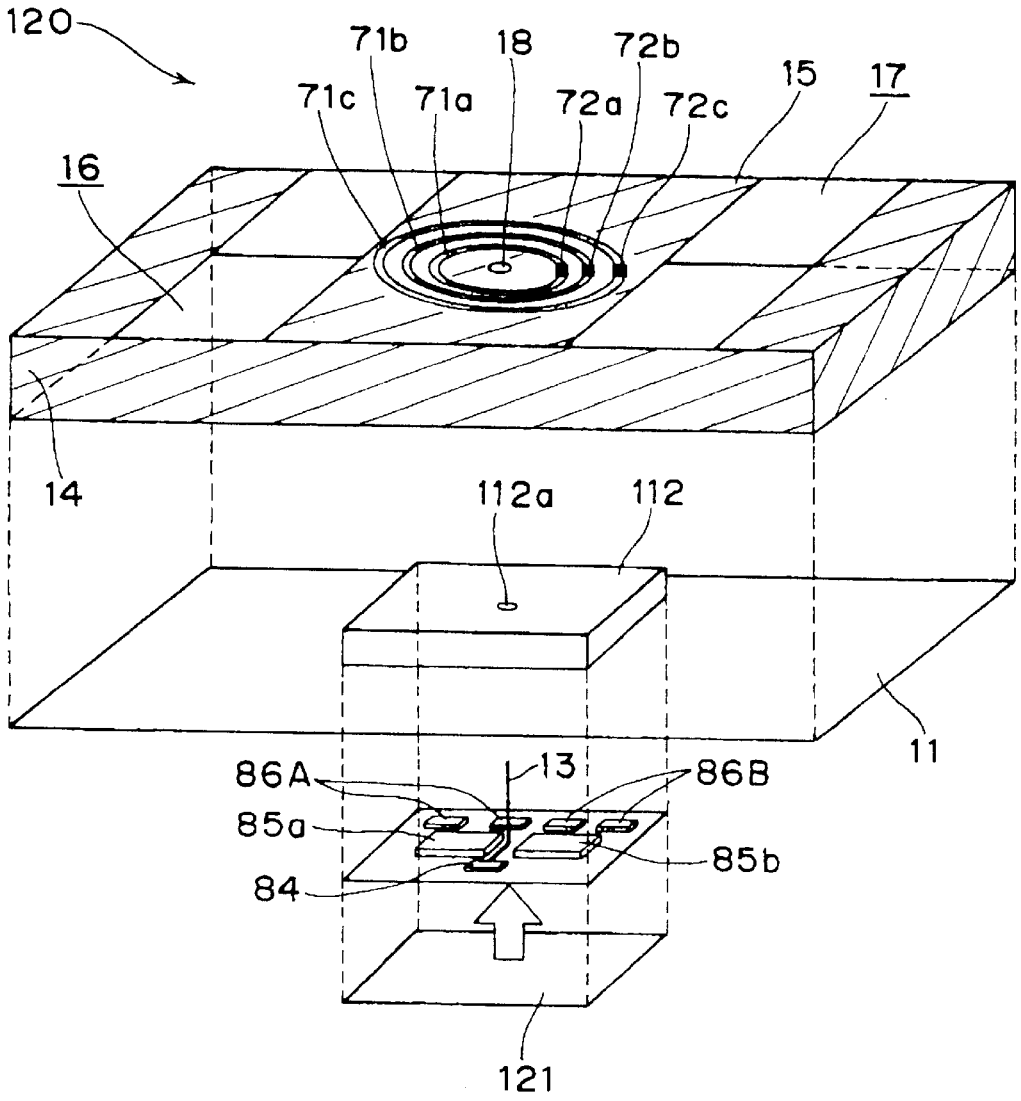
FIG. 32 illustrates an exploded view of an assembled structure of an antenna according to the tenth embodiment of the present invention.
Figure 33:
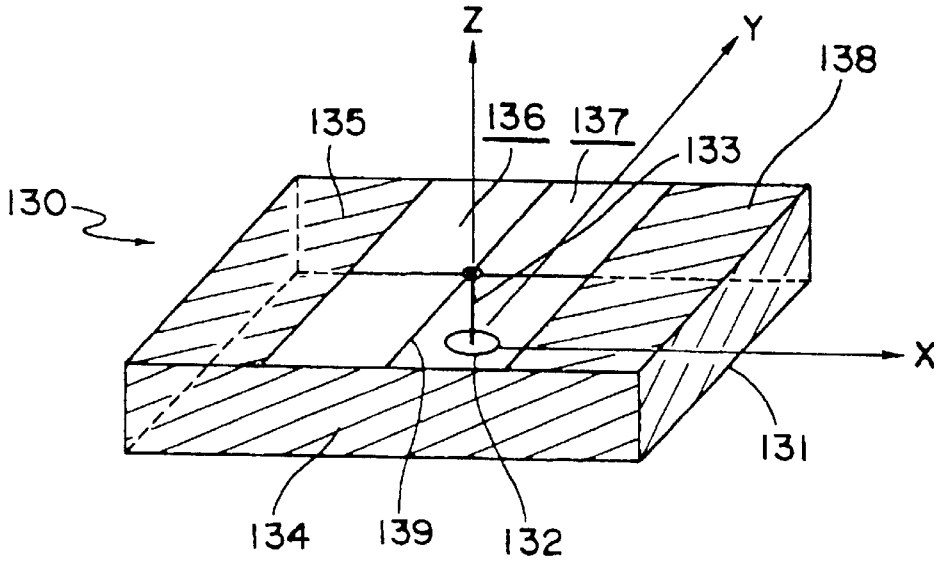
Fig. 33 PRIOR ART
FIG. 33 illustrates a configuration of a conventional antenna.
Figure 34:
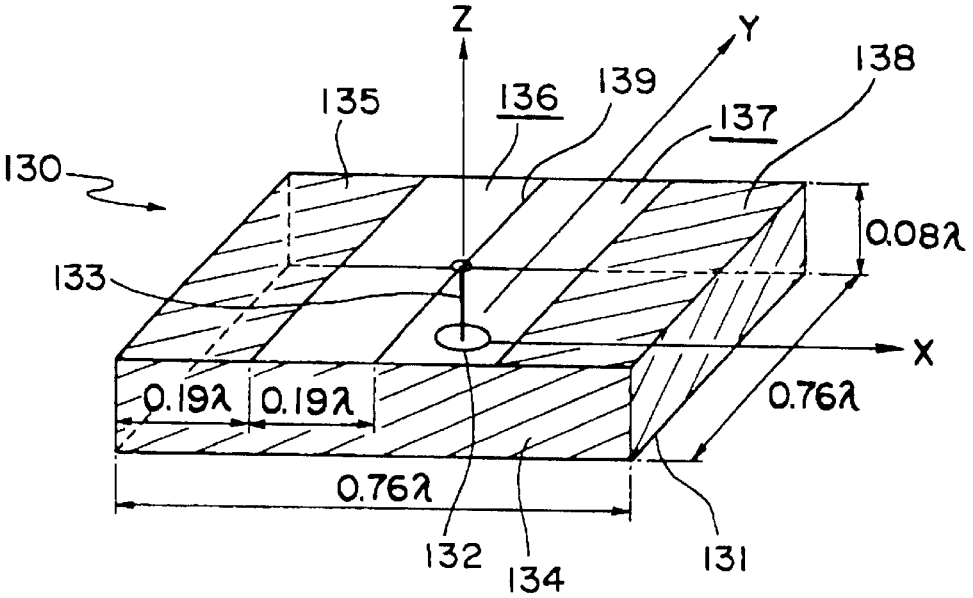
Fig. 34 PRIOR ART
FIG. 34 illustrates exemplary dimensions of the conventional antenna.
Figure 35:
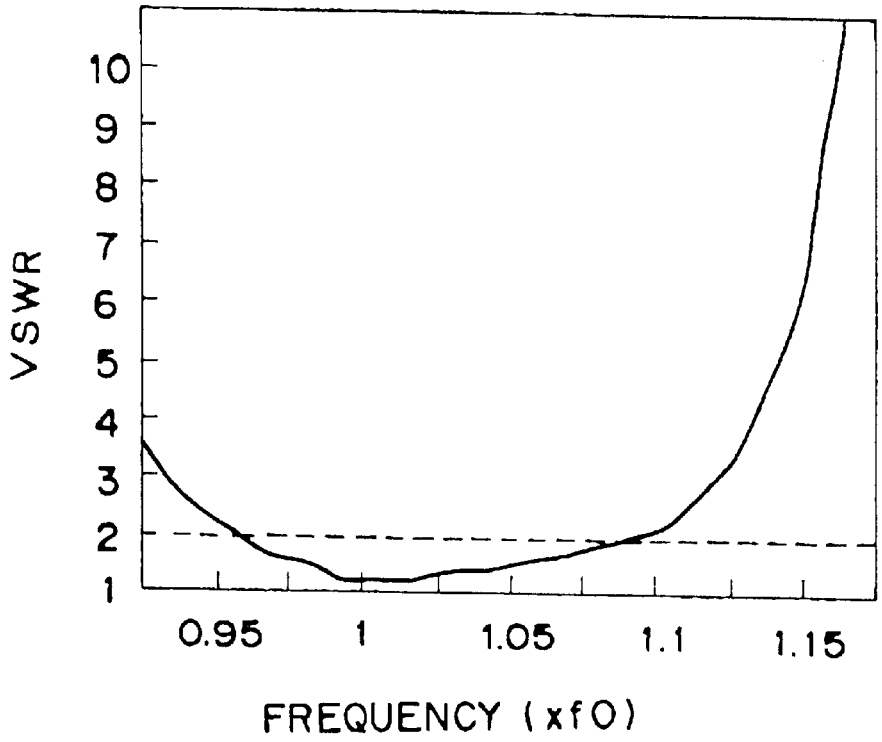
Fig. 35 PRIOR ART
FIG. 35 illustrates an impedance profile of the conventional antenna.
Figure 36:
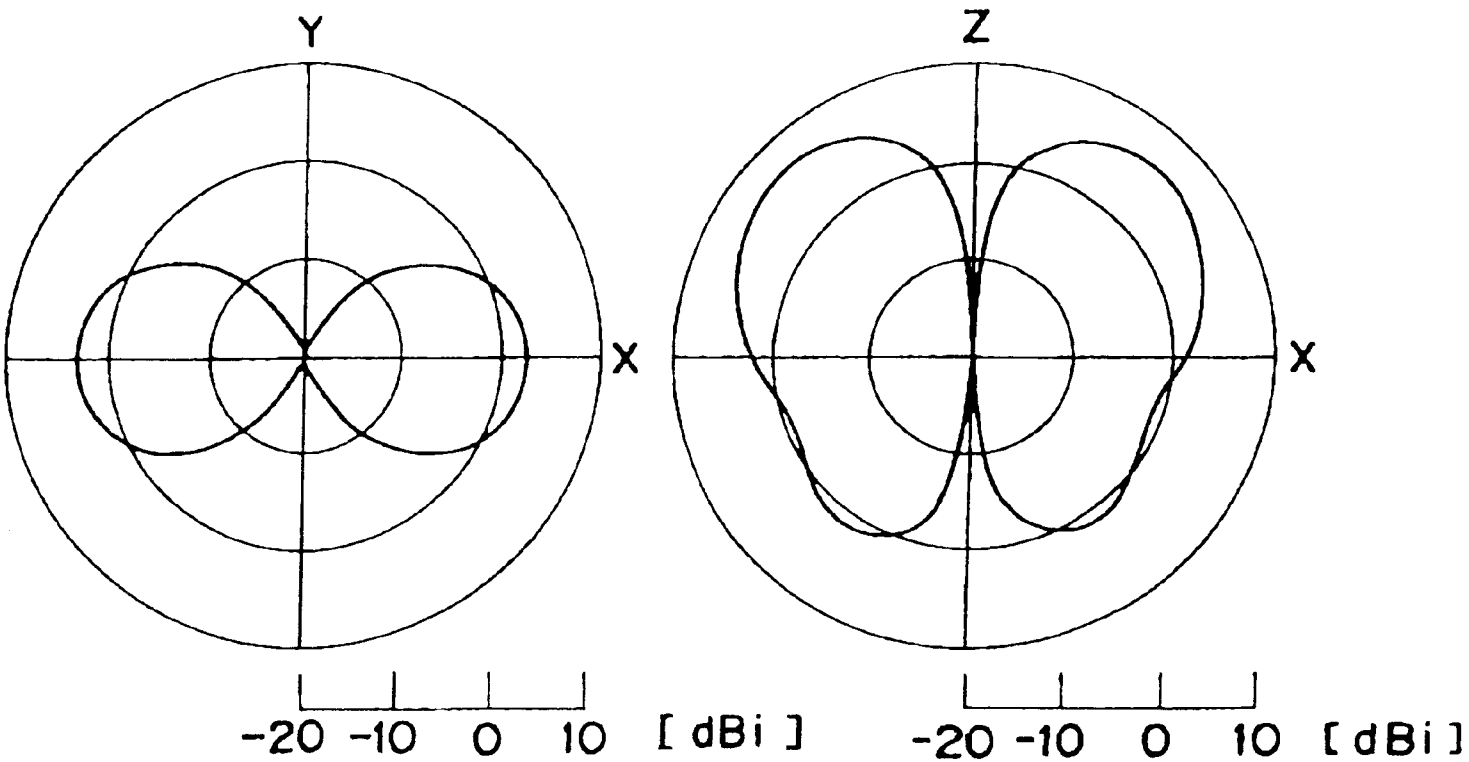
Fig. 36 PRIOR ART
FIG. 36 illustrates a radiation directivity of the conventional antenna.

FIG. 32 is an exploded perspective view of an assembled structure of an antenna according to the tenth embodiment of the present invention. The antenna 120 is substantially identical in the structure to that of the ninth embodiment. The antenna 120 of the tenth embodiment has a cover member 121 provided for shielding from below the inner space of the hollow protrusive portion 112 of the grounding conductor 11.

The cover member 121 protects the transmission/reception circuit 81 in the hollow space of the protrusive portion 112 of the grounding conductor 11 from hostile environmental conditions including dust and moisture. When the cover member 121 is made of a metallic material, it can inhibit any electric wave transmitted or received over the antenna 120 which affects on the action of the transmission/reception circuit 81.

It would be understood that the present is not limited to the forgoing embodiments but various modifications and changes in design are possible without departing from the scope of the present invention.

What is claimed is:

1. An antenna comprising:

a chassis consisting mainly of a grounding conductor provided as a bottom surface, a ceiling conductor provided as a top surface opposite to the grounding conductor, and a plurality of side conductors provided as antenna sides;

at least one opening provided in a part of said chassis which opens for radiation of electric waves;

a feeding point provided on said grounding conductor for power supply via a predetermined feeding line from the outside;

a frequency selectable circuit; and an antenna element connected to said feeding point at one end, connected to said ceiling conductor via said frequency selectable circuit at the other end, and surrounded by the side conductors.

2. The antenna according to claim 1, wherein said ceiling conductor has a generally annular slit provided therein about said antenna element, and said antenna further comprises another frequency selectable circuit connecting an inner edge and an outer edge forming the generally annular slit of said ceiling conductor to each other.

3. The antenna according to claim 2, wherein said ceiling conductor has at least one additional generally annular slit provided concentrically with the generally annular slit, and said antenna further comprises at least one additional frequency selectable circuit connecting an outer edge and an inner edge forming the at least one additional generally annular slit of said ceiling conductor to each other.

4. The antenna according to claim 3, wherein said chassis is situated in an XYZ orthogonal coordinate system with said grounding conductor extending along an XY-plane and said feeding point sitting at the origin so that said grounding conductor, said ceiling conductor, and the side conductors are symmetrical about a ZY-plane and the opening in said chassis is symmetrical about the ZY-plane.

5. The antenna according to claim 2, wherein the chassis is situated in an XYZ orthogonal coordinate system so with said grounding conductor extending along an XY-plane and said feeding point sitting at an origin so that said grounding conductor, said ceiling conductor, and said side conductors are symmetrical about ZY-plane and the opening in said chassis is symmetrical about the ZX-plane.

6. The antenna according to claim 1, wherein said chassis is situated in an XYZ orthogonal coordinate system with said grounding conductor extending along an XY-plane and said feeding point sitting at an origin so that said grounding conductor, said ceiling conductor, and said side conductors are symmetrical about a ZY-plane and the at least one opening in said chassis is symmetrical about the ZY-plane.

7. The antenna according to claim 6, wherein said grounding conductor, said ceiling conductor, and said side conductors are symmetrical about a ZX-plane and the at least one opening in said chassis is symmetrical about the ZX-plane.

8. The antenna according to claim 1, wherein said frequency selectable circuit is configured with a parallel resonance circuit.

9. The antenna according to claim 1, wherein said frequency selectable circuit is configured with a low-pass feeding line and electrically connected to the grounding filter.

10. The antenna according to claim 1, wherein said frequency selectable circuit is configured with a changeover filter.

11. The antenna according to claim 1, further comprising a matching conductor operable to match impedance with the feeding line and electrically connected to said grounding conductor.

12. The antenna according to claim 9, wherein said matching conductor is coupled via said frequency selectable circuit to said grounding conductor.

13. The antenna according to claim 11, wherein said matching conductor is electrically connected to said antenna element.

14. The antenna according to claim 1, wherein an inner space of said chassis is at least partially filled with a dielectric.

15. The antenna according to claim 1, wherein said conductor is a pattern of a metallic material provided on a dielectric substrate.

16. The antenna according to claim 1, further comprising an electric field adjusting conductor operable to change a distribution of electric field across the at least one opening.

17. The antenna according to claim 16, wherein said electric field adjusting conductor is coupled via said frequency selectable circuit to said chassis.

18. The antenna according to claim 1, further comprising an opening space variable means for changing an opening space of the at least one opening provided on said chassis.

19. The antenna according to claim 1, wherein said grounding conductor provided as said bottom surface is arranged in a circular shape.

20. The antenna according to claim 1, further comprising a transmission/reception circuit operable to transmit and receive signals of a specific frequency or frequency band, said transmission/reception circuit being connected at one end to said antenna element and connected at another end to a signal transmission cable which communicates with a predetermined device for processing a baseband signal.

21. The antenna according to claim 20, further comprising a cover member, wherein said transmission/reception circuit is accommodated in said chassis and shielded with said cover member.

22. The antenna according to claim 20, wherein said grounding conductor has a hollow protrusive portion provided thereon and said transmission/reception circuit is located on a lower side of said grounding conductor so as to be accommodated in a hollow space of the hollow protrusive portion.

23. The antenna according to claim 22, further comprising a cover member wherein the hollow space of the hollow protrusive portion of said grounding conductor is shielded with said cover member which is provided on the lower side of said grounding conductor.

24. The antenna according to claim 20, wherein said transmission/reception circuit is a plurality of passive elements without a power supply.

25. The antenna according to claim 20, wherein said transmission/reception circuit includes a high frequency IC operable to control the specific frequency or frequency band of a signal to be received or transmitted.

26. The antenna according to claim 20, wherein said transmission/reception circuit includes a filter having a predetermined passing frequency band.

27. The antenna according to claim 20, wherein said transmission/reception circuit includes a filter switching circuit having a plurality of filters which are different from each other in passing frequency band and a filter switch operable to switch between the filters so that one of the filters becomes available.

28. The antenna according to claim 25, wherein said transmission/reception circuit further includes at least one of an amplifier for transmission and an amplifier for reception.

29. The antenna according to claim 27, wherein said transmission/reception circuit further includes a plurality of amplifiers which are different from each other in amplifying gain for at least one of transmission and reception.

30. The antenna according to claim 29, further comprising a signal divider, wherein at least a portion of said amplifiers are for transmission and are connected to the signal transmission cable via said signal divider, said signal divider dividing a signal input from the signal transmission cable to a plurality of signals and outputting the signals to said amplifiers for transmission.

31. The antenna according to claim 29, further comprising a signal compositor, wherein at least a portion of said amplifiers are for reception and are connected to the signal transmission cable via said signal compositor, said signal compositor compounding a plurality of signals input from said amplifiers for reception to one signal and outputting the signal to the signal transmission cable.

32. The antenna according to claim 27, wherein said transmission/reception circuit further includes a plurality of amplifiers which are different from each other in operating frequency for at least one of transmission and reception.

33. The antenna according to claim 32, further comprising a signal divider, wherein at least a portion of said amplifiers are for transmission and are connected to the signal transmission cable via said signal divider, said signal divider dividing a signal input from the signal transmission cable to a plurality of signals and outputting the signals to said amplifiers for transmission.

34. The antenna according to claim 32, further comprising a signal compositor, wherein at least a portion of said amplifiers are for reception and are connected to the signal transmission cable via said signal compositor, the signal compositor compounding a plurality of signals input from said amplifiers for reception to one signal and outputting the signal to the signal transmission cable.

35. The antenna according to claim 20, wherein the signal transmission cable is an optical fiber, and said transmission/reception circuit includes at least one of a light passive element for transmission operable to perform photoelectric conversion and a light active element for reception operable to perform electric-optic conversion, connected to the optical fiber.

36. The antenna according to claim 35, further comprising a photocoupler, wherein said transmission/reception circuit includes both said light passive element and said light active element, said light passive element being connected to a first optical fiber and said light active element being connected to a second optical fiber, and said photocoupler coupling the first and second optical fibers to the optical fiber.

* * * * *

UNITED STATES PATENT AND TRADEMARK OFFICE

CERTIFICATE OF CORRECTION

PATENT NO. : 6,538,618 B2
DATED : March 25, 2003
INVENTOR(S) : Atsushi Yamamoto et al.

It is certified that error appears in the above-identified patent and that said Letters Patent is hereby corrected as shown below:

Title page,
Item [54], change "ANTENNA" to -- MULTI-RESONATED ANTENNA --.
Item [57], ABSTRACT,
Line 7, delete "said" after "of".

Column 18,
Line 55, change "consisting mainly of" to -- comprising --.
Line 57, change "the" to -- said --.
Line 60, add -- , -- after "chassis".
Line 63, change "power supply" to -- receiving power supplied --.
Line 63, delete "the" after "from".

Column 19,
Line 1, change "the other" to-- another --.
Lines 2 and 20, change "the" to -- said --.
Line 4, change "about" to -- around --.
Line 19, change "the " to -- an --.
Line 24, delete "so" after "system".
Line 28, add -- a -- after "about".
Line 29, change "ZX-plane." to -- ZY-plane. --.
Line 46, delete "feeding line and electrically connected to the grounding" after "low-pass".
Line 55, change "9" to -- 11 --.
Line 64, add -- ceiling -- after "said".

Column 20,
Line 48, change "25" to -- 27 --.

Signed and Sealed this

Thirtieth Day of September, 2003

JAMES E. ROGAN
*Director of the United States Patent and Trademark Office*